US005826868A

United States Patent [19]

Russell et al.

[11] Patent Number: 5,826,868

[45] Date of Patent: Oct. 27, 1998

[54] CONTROL SYSTEM FOR A CLOTH SPREADING MACHINE

[75] Inventors: Michael Dale Russell, Cookeville; David Alan Berezov; Jiakun Wu, both of Nashville, all of Tenn.

[73] Assignee: Saber Industries, Inc., Nashville, Tenn.

[21] Appl. No.: 578,036

[22] Filed: Dec. 26, 1995

[51] Int. Cl.[6] ..... B65H 29/46

[52] U.S. Cl. ..... 270/30.12; 270/30.13

[58] Field of Search ..... 270/30.01, 30.04, 270/30.12, 30.13

[56] References Cited

U.S. PATENT DOCUMENTS

| | | | |
|---|---|---|---|
| 3,684,273 | 8/1972 | Benson et al. | 270/30.12 |
| 3,791,641 | 2/1974 | Benson et al. | 270/30.12 |
| 3,913,904 | 10/1975 | Occhetti | 270/30.04 |
| 4,437,065 | 3/1984 | Smith et al. | 270/30.12 |
| 4,606,533 | 8/1986 | Fonio | 270/30.12 |
| 4,944,502 | 7/1990 | Platzer et al. | 270/30.12 |

OTHER PUBLICATIONS

Gerber Spreader Synchron 3–1000, 1994.
Eastman® CR 300, "Fully Automatic Craddle Feed Spreading Machine", 1994.
Eastman® Advantage 3000, 1989.
Otteman Advantage Spreader Machine, (No Date).
Super Craddle, 250–500 Models, (No Date).
Progress 11, Lectra Company, (No Date).

*Primary Examiner*—Hoang Nguyen
*Attorney, Agent, or Firm*—Waddey & Patterson; Mark J. Patterson

[57] ABSTRACT

A control system for a material spreading machine predetermines a machine velocity trajectory plan so that the velocity and acceleration of the machine down the spreading table can be controlled in real time. The control system includes encoders which provide real time information as to the actual machine velocity and material feed rate so that dynamic feedback and control of the spread can be maintained. Data from the machine velocity encoder is used to calculate the actual position of the machine along the table during the spread.

28 Claims, 41 Drawing Sheets

| | | | | | | |
|---|---|---|---|---|---|---|
| FIG. 8A | FIG. 8B | FIG. 8C | FIG. 8D | FIG. 8E | | |
| FIG. 8F | FIG. 8G | FIG. 8H | FIG. 8J | FIG. 8K | FIG. 8L | FIG. 8M |
| FIG. 8N | FIG. 8P | FIG. 8Q | FIG. 8R | FIG. 8S | FIG. 8T | FIG. 8U |
| FIG. 8V | FIG. 8W | FIG. 8X | FIG. 8Y | FIG. 8Z | FIG. 8AA | FIG. 8AB |
| FIG. 8AC | FIG. 8AD | FIG. 8AE | FIG. 8AF | FIG. 8AG | FIG. 8AH | |

FIG. 8

CONTROL SYSTEM FOR A CLOTH SPREADING MACHINE

BACKGROUND OF THE INVENTION

The present invention relates generally to cloth spreading machines used in the garment manufacturing industry. More particularly, this invention pertains to systems which are used to dynamically sense and control the position and velocity of a cloth spreading machine as it moves along a spreading table.

Automatic and semi-automatic cloth spreading machines have long been used in the manufacture of garments. The purpose of a spreading machine in such applications is to transport a roll of cloth or other material along an elongated spread table while feeding material from the roll to the table. After or while the material is spread, usually in multiple layers or plies, various cutting and other operations can be performed on the material.

One highly desired characteristic of a cloth spreading machine is the ability to travel along the table in a manner where the machine control system "knows" the position of the machine on the table so that consistent, precision operations can be undertaken at that location. For example, by knowing the precise location of the spreading machine as it travels along the spreading table, other data that is useful to manufacturing and cloth usage can be obtained, such as start points, end points, and splice marks. It is also important to an efficient and accurate spreading operation that the spreading machine be able to adjust the position of a cut at the end of the table so that every cloth ply end will line up exactly. Some garment manufacturing operations require "step spreads" where a different number of cloth layers are cut at different points along the table. Having a spreading machine that can accurately position itself to implement a step spread is crucial.

Unfortunately, the cloth spreading machines known in the prior art have been deficient in these areas because of their relatively crude control systems. In a typical prior art cloth spreading machine, the control system starts the machine moving from one end of the spread table and accelerates the spreading machine to a top end speed. The machine continues running at that top end speed until a mechanically activated slow-down sensor is tripped by the moving machine. This tells the control system to slow the machine down and continue travelling at low speed until it reaches a limit switch at the end stop on the table. This process is repeated for multiple cloth plies until the spread is completed. Using such prior art control systems, the spreading machine is not really controlled dynamically as it moves down the table. Rather, once the spreading operation is started, the machine accelerates and continues to run at top speed until it receives a signal from either a mechanical or optical slow down switch. Without the slow down switch, the machine would continue to run at high speed off the table. Position accuracy with such a system is poor, typically +/−¼ inches. Also, such machines typically experience a "bump" effect at the end stops on the spreading table.

Further, prior art spreading machine control systems really do not "know" at any given point in time where the machine is along the table. Prior art systems attempt to approximate a location by counting pulses from a motor shaft encoder to determine distance, or by optically detecting light "dots," using the table as a type of large-scale linear ruler. These prior art control systems, which may depend on a mechanical gear track attached to the table, or on reflective tape applied to the table which is read by a sensor, are subject to mechanical variations and errors. These errors can accumulate on long spreads which can be as much as 200 yards. Therefore, they do not provide accurate and consistent information which will allow the control system to know the location of the machine along the table at any given point in time.

Spreading machines deliver material to the spread table by feeding the cloth or other material off of a roll which is held in a cradle or by a roll bar. As the machine moves down the table, the roll is turned axially so that the cloth is delivered from the cradle or roll bar to the table. To insure an accurate and tension-free delivery of cloth, the cloth must feed off the roll at a rate which matches or at least is constantly proportional to the speed of the machine as it moves down the table. This speed matching can be difficult for a variety of reasons, including the constantly changing cloth roll diameter during the spread. Consequently, many machine designers have ignored this problem which has resulted in spreading machines which stretch the cloth and which have poor end-ply accuracy. Some designers have attempted to compensate for this by allowing for manual variation of the ratio between the speed of the cloth feed mechanism and the machine drive mechanism, by using a variable feed drive pulley. However, very slight and precise speed ratio adjustments are difficult to make using this technique.

What is needed, then, is a control system for a cloth spreading machine which can accurately determine and control the position of the machine along a spreading table in real time, to provide a tension-free spread with precise cloth operations and end-ply positioning. Such a system is presently lacking in the prior art.

SUMMARY OF THE INVENTION

In the improved control system for cloth spreading machines of this invention, shaft encoders are attached to a spreading machine to provide real time information as to machine travel velocity and material feed rate. This encoder data is filtered, decoded, and provided to a microcontroller. Using a machine acceleration rate, spread distance, and top speed information inputed to the control system by the machine operator, a machine trajectory is calculated, giving the control system a trajectory "plan" which pre-determine machine velocity as a function of time throughout the spread.

Once the spread begins, the encoder data is monitored by the control system to compute the actual machine velocity and material feed rate in real time. The machine speed is continuously adjusted by the control system to keep the machine on the pre-planned speed trajectory. In addition, data from the machine velocity encoder is integrated with respect to time by the microcontroller in the control system to compute an actual distance travelled by the machine. Therefore, the control system can determine the distance travelled by and the location of the machine at any given point in time, with a very small rate of error. System induced errors can be dynamically corrected as the spread occurs, when the machine travels over a home point, which is a pre-determined location on the spread table.

The machine velocity data is also provided to a closed loop control system for the cloth feed mechanism. Prior to the beginning of the spread, a planned feed trajectory is determined by the microcontroller in the control system, taking into account the mechanical design and gear ratios of the machine. The feed rate encoder constantly provides the real time feed rate data to the microcontroller, which can then adjust the feed rate to make sure that it conforms to the planned feed trajectory.

To compensate for the fact that the rate of material that is actually put down is a function of varying tension within the roll of material, the control system uses a dancer bar which rests on the cloth and which is pivotally connected to an angular deflection encoder. A deviation of angular deflection from normal is detected by the encoder and is used by the control system to adjust the feed rate, thereby producing a tensionless spread.

DESCRIPTION OF THE PREFERRED EMBODIMENT

Spreading Machine Mechanical Design

Figure 1:
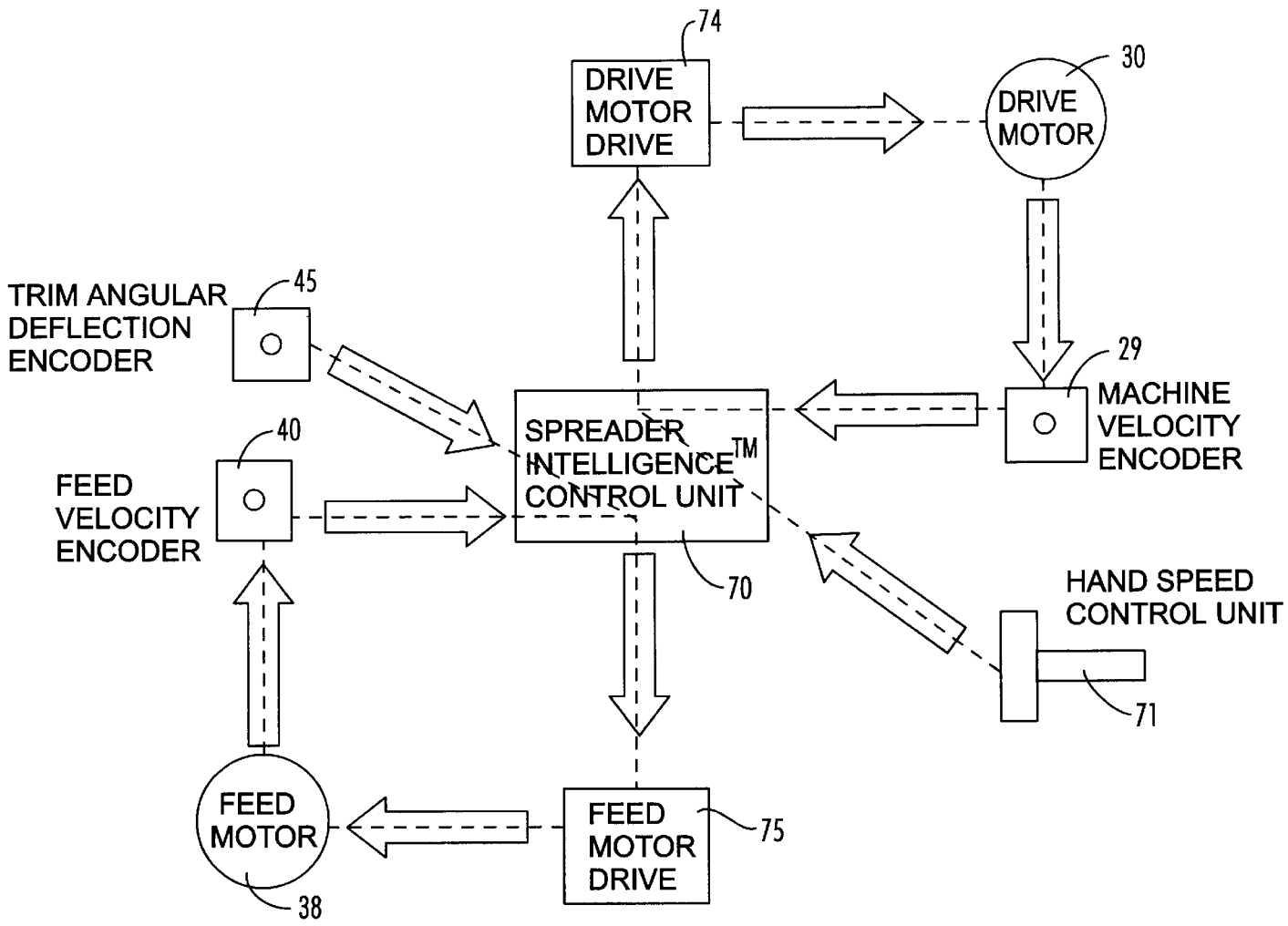
FIG. 1 is block diagram showing the general arrangement and interconnection of the functional units of the improved spreading machine control system, including the electromechanical devices associated with the spreading machine which are controlled by the system.

The improved control system of the present invention can be used with a variety of conventional cloth spreading machines including cradle feed systems, bar feed/feed roller systems, dual feed systems, pull-off-the-bar systems, stationary cradle/pull systems, and turntable systems. These machines are used to spread a variety of materials, including cloth, vinyl, and other fabrics. To describe the structure and functioning of a preferred arrangement of the improved control system, FIGS. 3–6 illustrate the mechanical design of a typical cradle feed spreading machine 10 which is of generally conventional design. However, the preferred embodiment includes some novel mechanical and electromechanical features to improve its functioning in response to the improved control system of this invention.

Spreading machine 10 combines two distinct mechanical assemblies, a cradle frame assembly 14 which is attached to and rests on a main frame assembly 15. The spreading machine 10 rides horizontally along a spreading table 11 on a set of four drive wheels 20.

The cradle frame assembly 14 supports a roll 12 of cloth or other material on opposed first and second cradle belts 36 and 37. First cradle belt 36 rotates around first cradle roller 34 while being driven by a cradle drive shaft wheel 43 which is attached to cradle drive shaft 42. The second cradle belt 37 rotates around second cradle roller 35, also driven by cradle drive shaft wheel 43. So that first and second cradle belts 36 and 37 can be driven simultaneously, first and second cradle belts 36 and 37 are each split into multiple spaced parallel sections (not shown), with alternating sections of first and second cradle belts 36 and 37 positioned around cradle drive shaft wheel 43.

The cradle drive shaft 42 is attached to a cradle drive pulley 41 having a substantially greater diameter. Cradle drive pulley 41 is powered by cradle drive belt 40 which, in turn, is driven by cradle feed motor 38 and corresponding cradle motor shaft sprocket 39. Respective end sections of first cradle roller 34, second cradle roller 35, and cradle drive shaft 42 are attached and secured in a conventional bearing assemblies mounted to opposed cradle frame sidewalls 47. In a preferred embodiment of machine 10, the cradle feed motor 38 is a 3-phase, 1 HP, 230 VAC motor.

Figure 3:
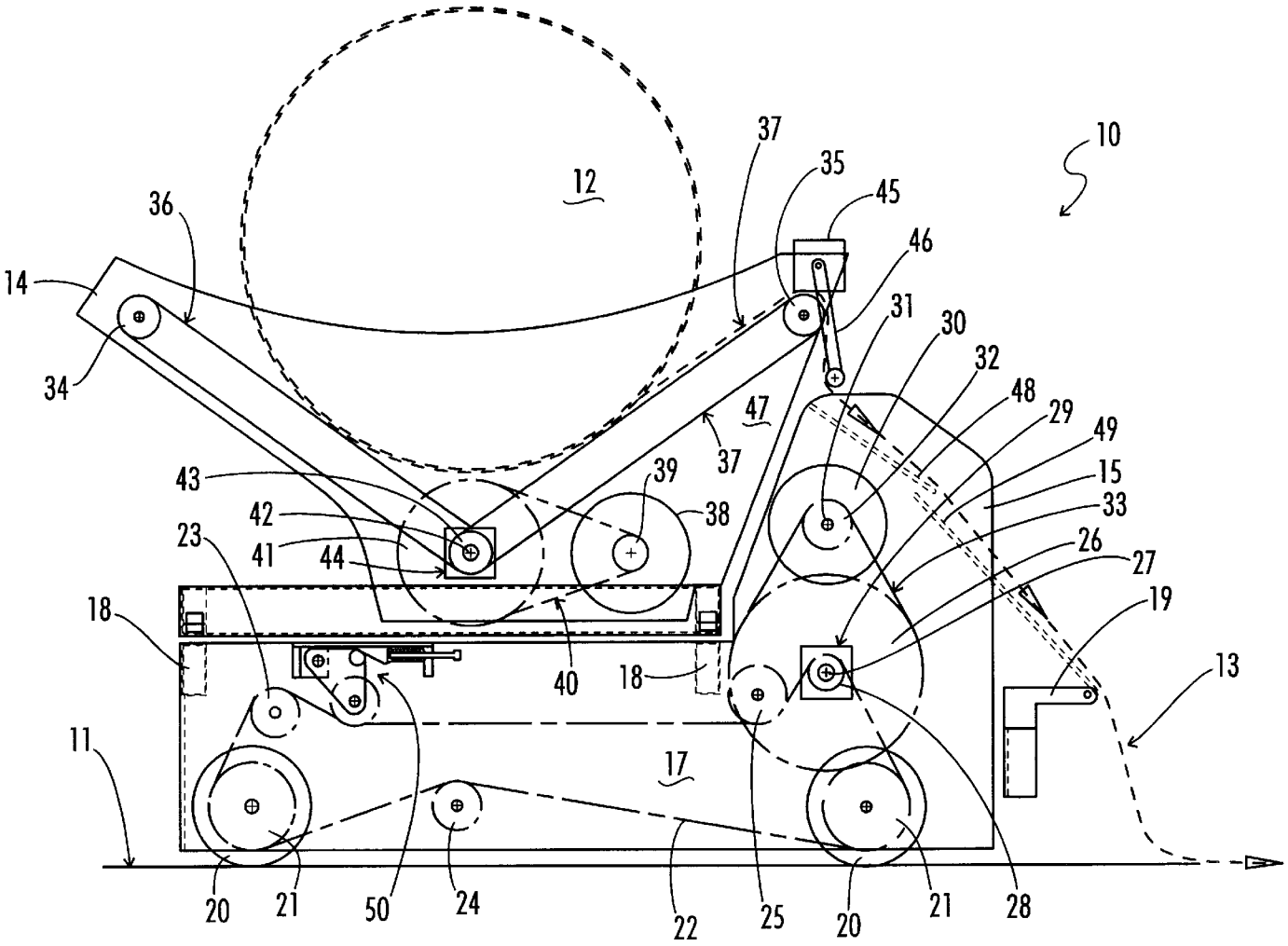
FIG. 3 is a side view of a spreading machine which includes the improved control system.

As seen in FIG. 3, a cloth spread path 13 is established from material roll 12, along the upper surface of second cradle belt 37, and over a material ramp which is split into overlapping sections 48 and 49. The cloth would then be engaged by a conventional spreading unit (not shown) mounted to elevator bracket 19, from which the cloth is actually spread upon the table 11. An example of a spreading unit that could be used is described in U.S. Pat. No. 4,380,330, the disclosure of which is incorporated by reference.

The lower end of a cloth trim dancer bar 46 is biased against and rests on the material that moves along spread path 13. As part of the control system which will be discussed in more detail below, the upper end of dancer bar 46 is pivotally secured to a cloth trim or angular deflection encoder 45 which, as further described below, provides real time angular deflection information to the control system. This allows the system to monitor material tension during a spread. A feed rate encoder 44 is attached proximate to cradle drive shaft 42, to provide real-time shaft speed information to the control system.

Figure 4:
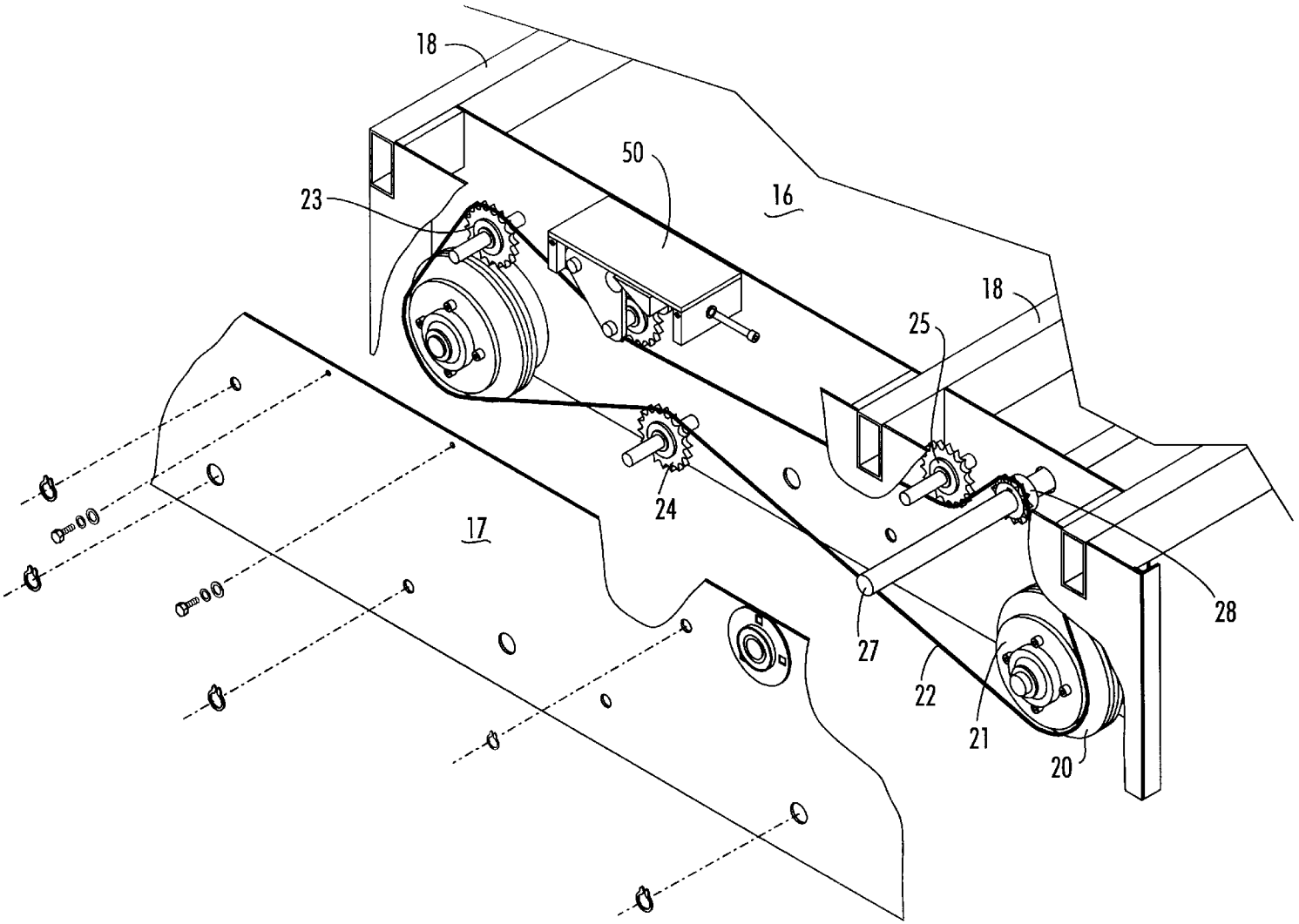
FIG. 4 is a partial perspective view of the of the spreading machine of FIG. 3, with the side panel removed to expose the drive belt and drive wheel assembly.

Cradle frame assembly 14 is mounted to main frame assembly 15, resting in cradle frame retaining slots 18, which are incorporated into main frame top plate 16, best seen on FIG. 4. The drive system for main frame assembly 15 and therefore spreading machine 10, starts with a main drive motor 30 and motor shaft 31 to which is attached a main drive motor shaft sprocket 32. Drive motor belt 33, which is driven by main drive motor shaft sprocket 32, rotates a larger diameter main drive pulley 26. The main drive shaft 27 is connected to and drives main drive shaft sprocket 28. Main drive belt 22 loops around drive wheel pulleys 21 on drive wheels 20 while being driven by main drive shaft pulley 28. Idler sprockets 23, 24, and 25 provide proper belt tension and orientation as main drive belt 22 loops around its drive path. A shaft encoder 29 is mounted proximate drive motor shaft 31 to provide real time signals corresponding to an actual velocity of the machine 10. Although reference is made herein to a main drive belt, it will be apparent that a drive chain can also be used with equivalent effect.

A type 716-5-128-0-S-4-S-S-Y Accu-Coder optical shaft encoder from EPC (Sandpoint, Id.) can be used for angular deflection encoder 45, the feed rate encoder 44, and the machine velocity encoder 29.

Figure 5:
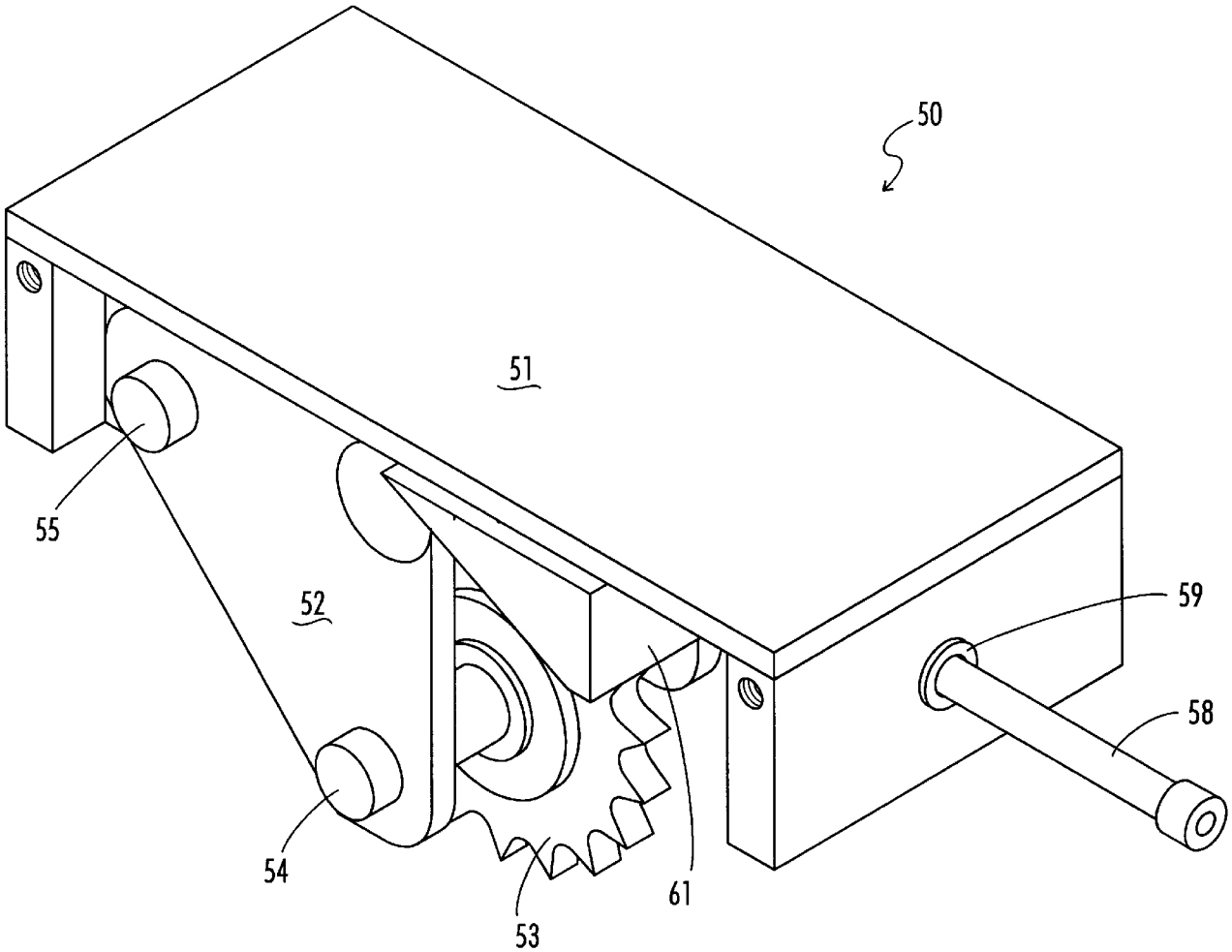
FIG. 5 is an enlarged perspective view of the chain tensioner assembly used in the spreading machine of FIG. 3.
Figure 6:
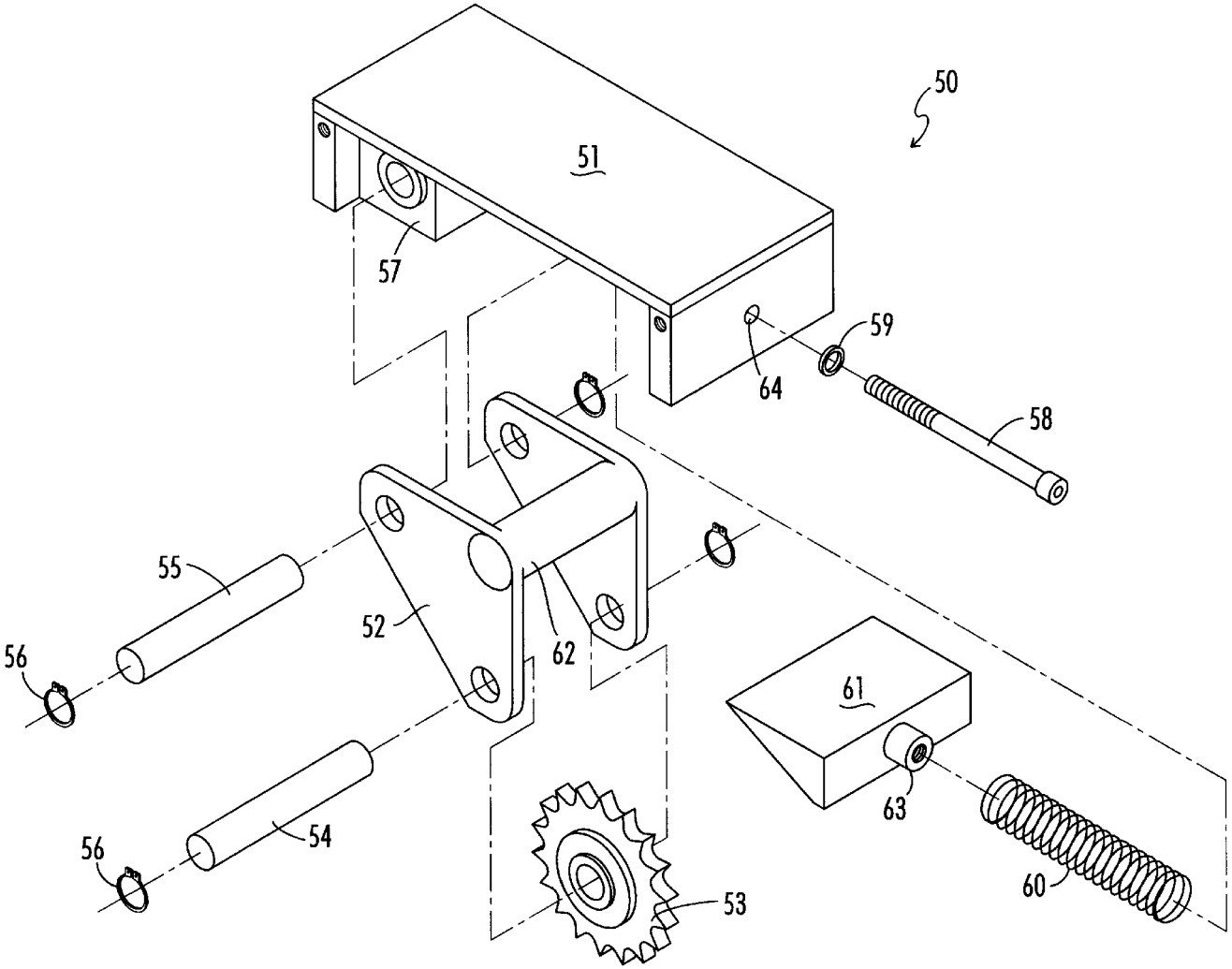
FIG. 6 is an exploded view of the chain tensioner assembly of FIG. 5.

An automatic chain tensioner assembly 50, which is illustrated more particularly in FIGS. 5 and 6, provides automatic control of the tension on drive belt 22 which eliminates mechanical backlash and is very helpful in allowing the control system of the present invention to implement precision and accurate movement of the spreading machine 10. Accordingly, in automatic chain tensioner assembly 50, a tension sprocket 53 rotates on a shaft 44 which, in turn, is suspended and supported through lower openings in bracket 52. Bracket 52 is pivotally attached to top frame 51 by a mounting shaft 55 which passes through a pair of upper holes in bracket 52. Roller bracket mounting shaft 55 is supported in a block 57 which is attached to the underside of top frame 51. Shaft 54 and mounting shaft 55 are fixed within bracket 52 by a pair of split rings 56 attached at end of the corresponding shaft.

A generally triangular-shaped tension wedge 61 contacts the outer surface of cylindrical section 62 of roller bracket 52. At the wide end of tension wedge 61, an internally threaded cylindrical portion 63 receives a threaded end of tension adjuster 58, which passes through opening 64 at one end of frame 51. Spring 60 surrounds the portion of tension adjuster 58 which is interior to frame 51, with a washer 59 on the exterior portion of adjuster 58. Accordingly, spring 60 biases tension wedge 61 against the bracket 52. By rotating tension adjuster 58, the lateral position of tension wedge 61 can be varied, thereby setting a preferred level of tension applied to main drive belt 22 by tension sprocket 53.

Although the drive mechanism is shown for only two drive wheels 20, in a preferred embodiment of machine 10, the two drive wheels 20 on the opposite side of machine 10 (not shown) would have the same mechanism so that drive power is applied to both sides of the main frame 15, by either the same drive motor 30 or a second, synchronously controlled drive motor.

Not shown but normally found in a conventional spreading machine are elevator and edge control mechanisms. The purpose of the elevator mechanism is to adjust the height of the spread as multiple material plies are spread along the table 11. A number of conventional mechanisms can be used to accomplish this, such as a manually operated gear rack, motor and gear rack, and motor and chain drive. An example of one such mechanism is described in U.S. Pat. No. 4,380,330, the disclosure of which is incorporated by reference. In a preferred embodiment of machine 10 and control system 70 as described below, an automatic elevator control would be used in which the spread height is increased in ⅛ inch increments by a motor and chain mechanism for a pre-determined number of plies, as communicated to the control system 70 by the operator.

The edge control unit photoelectrically monitors the position of the material edges on the spread table 11 as the spread occurs, to insure that the edges of the material are aligned vertically. Again, such systems are conventional. Typically, the cradle frame 14 includes a carriage which can re-position the frame 14 laterally, using a linear actuator attached to the main frame 15 which responds to signals from the edge sensors. Edge control techniques and sensors are described in U.S. Pat. Nos. 4,380,330 and 3,811,669, the disclosure of which are incorporated by reference.

Improved Control System General Description

To provide the needed improvements in machine positioning and control over the prior art, in conjunction with accurate and tension free material feed, the two basic motions of a spreading machine—machine drive motion and cradle/roll bar feed motion—need to be precisely controlled and coordinated with each other. Accordingly, the improved control system of the present invention has two basic functional sections, illustrated in FIGS. 1 and 2. The first functional section is for measurement of machine position and in a preferred embodiment of the system, will include an incremental machine velocity encoder 29, cradle drive shaft (feed rate) encoder 44, and cloth trim (angular deflection) encoder 45. Encoders 29, 44, and 45 are optical shaft encoders which provide real time shaft speed or position data which are filtered by a filter section 26, with the filtered signals then supplied to a system data bus 83 through decoder and counter section 77 (quadrature decoder circuits U2, U4, U9; binary up/down counters U3, U5; and hex inverter circuit U11; quad AND gate U13; and quad OR gates U14–16, all on FIG. 8).

Timing and support functions for system 70 are provided by timing and processor support section 79 (clock oscillator U32 and serial timekeeping circuit U17 on FIG. 8). Because the encoders 29, 44, and 45 provide only relative measurements, a home pulse generator 84 of conventional design is also provided which indicates an electronic zero point for the decoders.

The second functional section of the improved control system 70 is for closed loop digital control of the spreading machine drive system (main drive motor 30) and the cradle feed system (cradle feed motor 38). To provide this closed loop digital control, a microcontroller 78 (U10 on FIG. 8) is programmed to implement the necessary control algorithms as described below and in the Appendix, and interfaces with main drive motor 30 and cradle feed motor 38 through drive motor drive 74 and feed motor drive 75, respectively. The required analog drive control signals for motor drive 75 are provided by D/A converter section 82 (D/A converters U18 and U19 on FIG. 8), which receive digital drive control signals from controller 78 through system bus 83.

The control system 70 will also preferably interface through the system bus 83 with an edge sensor and control unit 80 and an elevator control unit 81.

The operator interface of system 10 includes an LCD display module 73 (U1 and related components on FIG. 8) and a keypad unit 72 (switches S1 through S21, S24 through S30 and latching circuits U6 and U7 on FIG. 8). The keypad unit 72 is used by the operator to input to the control system 70 the spread parameters necessary to control the spread (including the number of plies, ply count, elevator height adjustment, spread length, machine top end speed). The machine acceleration rate is also an important parameter used to determine the velocity trajectory plan for the machine, as described below. The machine acceleration rate will be selectable by the user or automatically determined by the microcontroller based on the selected top speed over a range extending up to 115 yards/minute. Preferably, the machine acceleration rate will be variable over a range from 0.25 yards/sec/sec to 0.75 yards/sec/sec. Optionally, timing and support section 79 can include a disk drive or other computer storage facility, which the microcontroller 78 in conventional fashion can access to obtain the spread parameters.

Spreading Machine Drive Control

Unlike prior art control systems for spreading machines, the improved control system of this invention "knows" the position of the machine along the spreading table, in real time, at any point in time. To accomplish this, the control system 70 and more specifically the microcontroller 78 calculates a vector or trajectory, in which the drive motion path is predetermined, as represented by the linear displacement of the spreading machine 10 down the table 11, the velocity of the machine, and the machine acceleration. By using this novel technique, the control system can then determine the position of the machine at any given point in time based on its velocity, and is not dependent on pulse counting or other physical relationship between the moving machine and the table.

The trajectory plan algorithm generates the motion path for the spreading machine in relation to time. The motion path can be represented by the motion variables as functions of time. For simplicity, the motion path is represented by the machine displacement D(t), velocity V(t), and acceleration A(t). In order to develop the algorithm, the necessary constants are defined as follows:

L—length of the spread;

$V_t$—top spreading speed, as appropriate for a given material type and front-end configuration;

A—acceleration level, as determined by material type and front-end configuration;

$L_a$—displacement of the spreading machine during acceleration and deceleration; where, $$L_a=2*V_t^2/A+V_t/2.$$

To maintain a smooth machine motion, several trajectory plan schemes, such as cubic polynomial, cosine function, and LSPB (Linear Segments with Parabolic Blends) can be used. For this application, LSPB is the most appropriate and is used in this embodiment of the control system 70 to plan the trajectory. The algorithm can be represented mathematically as:

$$D(t)=\begin{cases} At^2/2, & 0<D(t)<L_a \\ L_a+V_t t, & L_a<D(t)<L-L_a \\ L-L_a+At^2/2, & L-L_a<D(t)<L \end{cases}$$

$$V(t)=\begin{cases} At, & O<D(t)<L_a \\ V_t, & L_a<D(t)<L-L_a \\ V_t-At, & L-L_a<D(t)<L \end{cases}$$

$$a(t)=\begin{cases} A, & 0<D(t)<L_a \\ 0, & L_a<D(t)<L-L_a \\ -A, & L-L_a<D(t)<L \end{cases}$$

Figure 9:
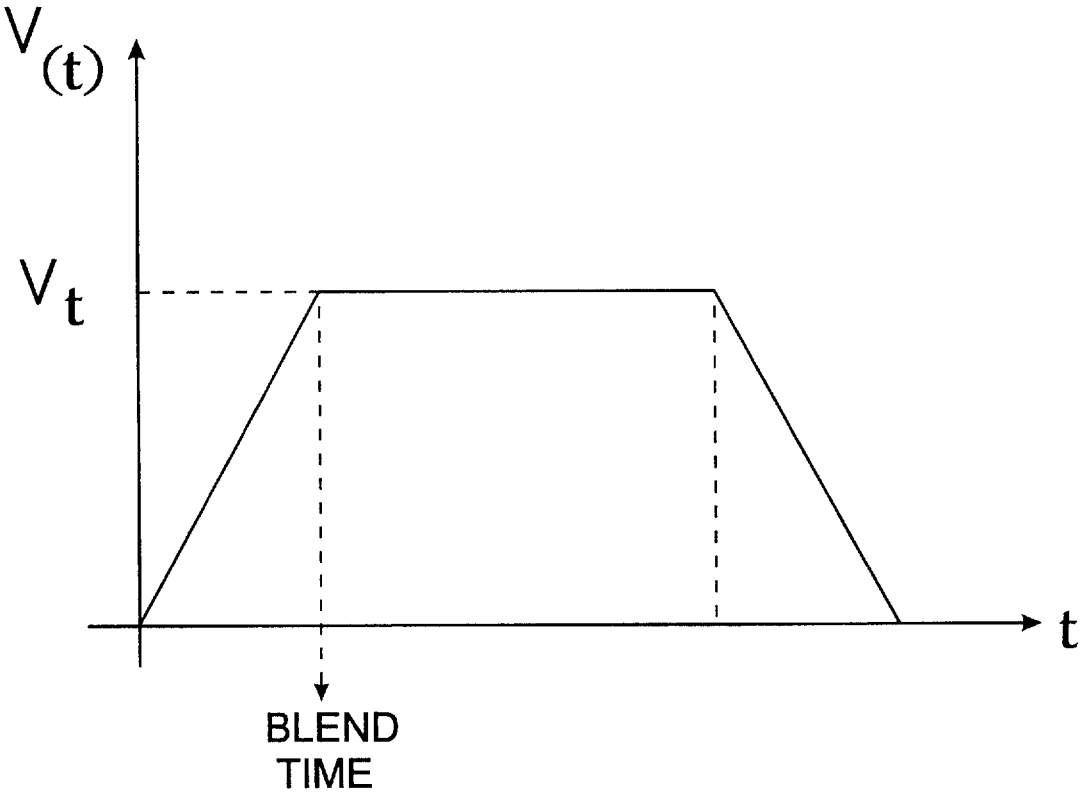
FIG. 9 is a graphical representation of a trajectory plan (machine velocity as a function of time) which is implemented by a preferred embodiment of the improved control system.

The trajectory algorithm or trajectory plan which is established by these formulas can be graphically represented as shown in FIG. 9. The blend time is the transition period for a change during acceleration.

A PID (Proportional-Integral-Derivative) algorithm is used to determine the control signals use to drive the drive and feed motors 30 and 38 to follow the commanded trajectory. In this control system 70, the proportional component is the velocity V(t), the integral component is the displacement D(t), and the derivative component is the acceleration A(t). Then the PID algorithm is represented as:

$$S(t)=K_p(V(t)-\hat{v}(t))+K_i(D(t)-\hat{D}(t))+K_d(A(t)-\hat{A}(t))$$

where, $\hat{V}(t)$ is the measured value of machine velocity;

$\hat{D}(t)$ is the measured value of machine displacement;

$\hat{a}(t)$ is the measured value of machine acceleration;

$K_p$ is the proportional gain, and has the value of 0.5;

$K_d$ is the derivative gain, and has the value of 0.0;

$K_i$ is the integral gain, and has the value of 0.25;

The gain parameters listed above are optimized for a spreading machine 10 having 250 lb. capacity for material roll 12. Because the machine dynamics depend on the actual mechanical structure, the gain parameters need to be adjusted for machines which have different roll capacities.

In the preferred embodiment of the control system 70, a PID algorithm is derived from machine velocity trajectory plan for both drive and feed motor control. However, it is also possible to use the spread parameters selected by the user to separately generate a feed trajectory plan, with a feed motor control PID algorithm then derived from the feed trajectory plan.

Figure 2:
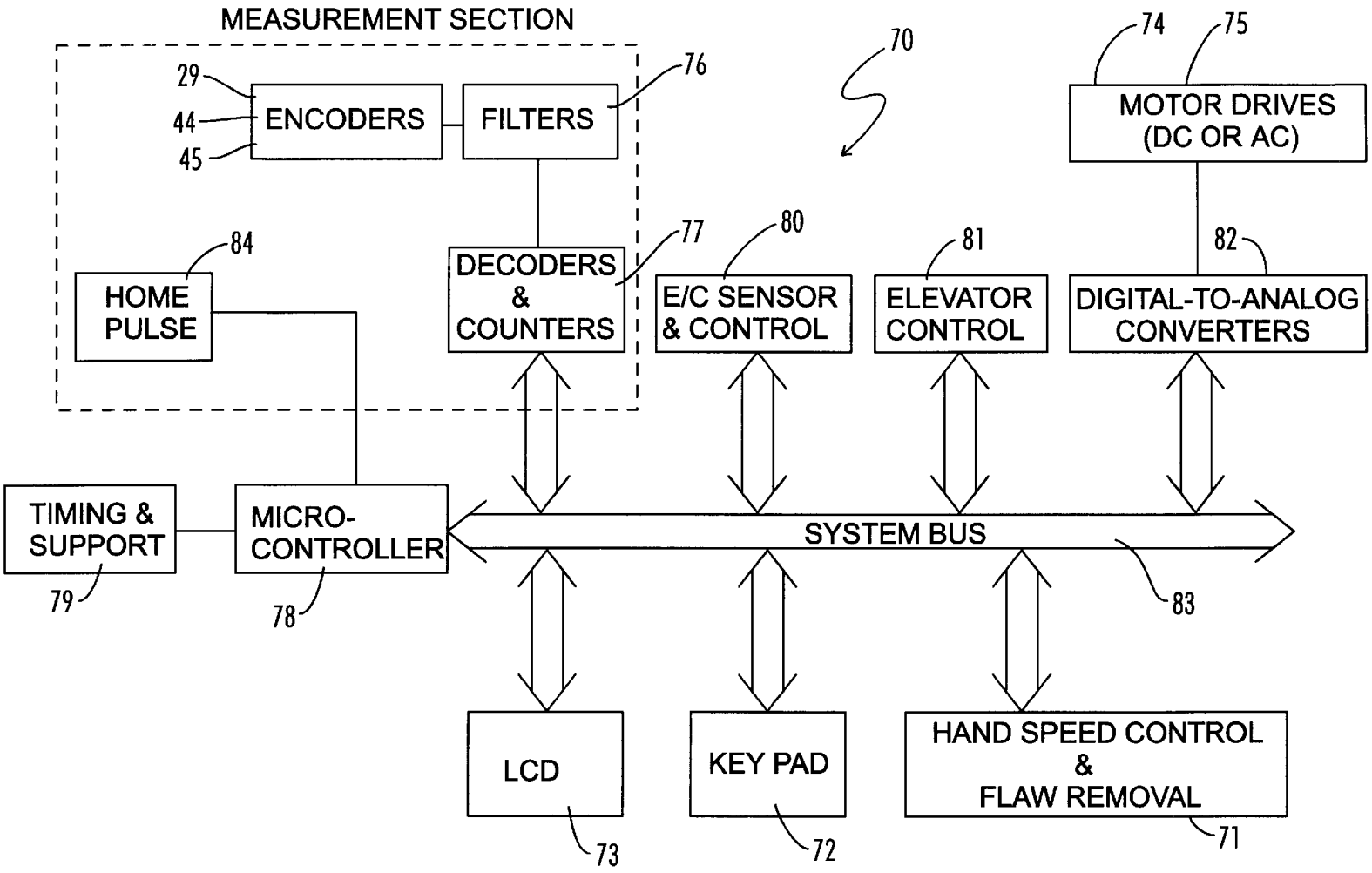
FIG. 2 is a block diagram which generally illustrates the architecture of the improved control system and related system bus and measurement/control devices.

Referring to FIGS. 1 and 2, the implementation of the machine velocity trajectory plan algorithm and PID algorithms in a preferred embodiment of the control system 70 can be described. The drive motor 30 placed under a closed loop digital control by microcontroller 78. The machine velocity encoder 29 which is proximate the main drive shaft 27 is an incremental encoder which provides real time feedback of drive motor rotation/machine velocity information for the closed loop. The predetermined machine velocity information is generated by the trajectory plan algorithm as described above, which computes the machine position and velocity curve based on a pre-selected spreading length and spreading speed. Then, a PID algorithm as described above is executed to generate a digital then analog control signal to the drive motor drive 74, through the digital to analog converter section 82. The drive motor drive 74, of course, then converts the received drive control signal and adjusts the electrical power which drives drive motor 30. If the rotation/velocity data generated by machine velocity encoder 29 indicates that the machine velocity is deviating from the predetermined trajectory plan, microcontroller 78 senses and calculates the deviation and dynamically adjusts the control signal which is sent to drive motor drive 74.

As is customary in cloth spreading machines, a hand speed control unit 71 is also provided so that the operator of the machine can control the machine manually. Accordingly, when the hand speed control unit 71 is engaged, a signal is sent along system bus 83 to microcontroller 78. When microcontroller 78 receives the hand speed control unit activation signal, it then ignores the feedback from machine velocity encoder 29. Consequently, digital control of machine velocity becomes open loop and the position and speed of the spreading machine is entirely controlled by the operator, using the hand speed control unit 71.

Spreading Machine Material Feed Control

Figure 7:
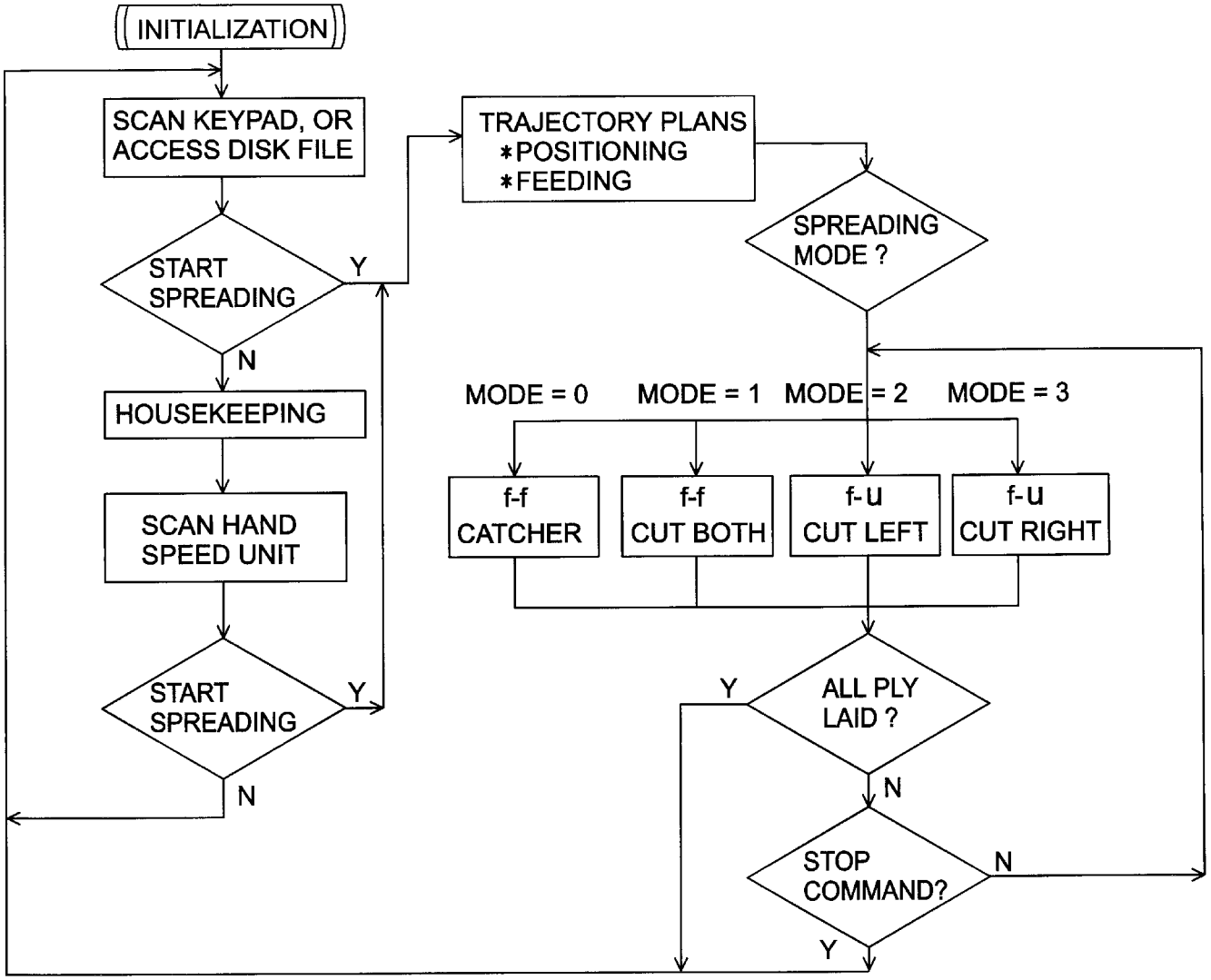
FIG. 7 is a logic diagram and flow chart which shows the basic sequence of operations of the improved control system of the present invention.
Figure 8A:
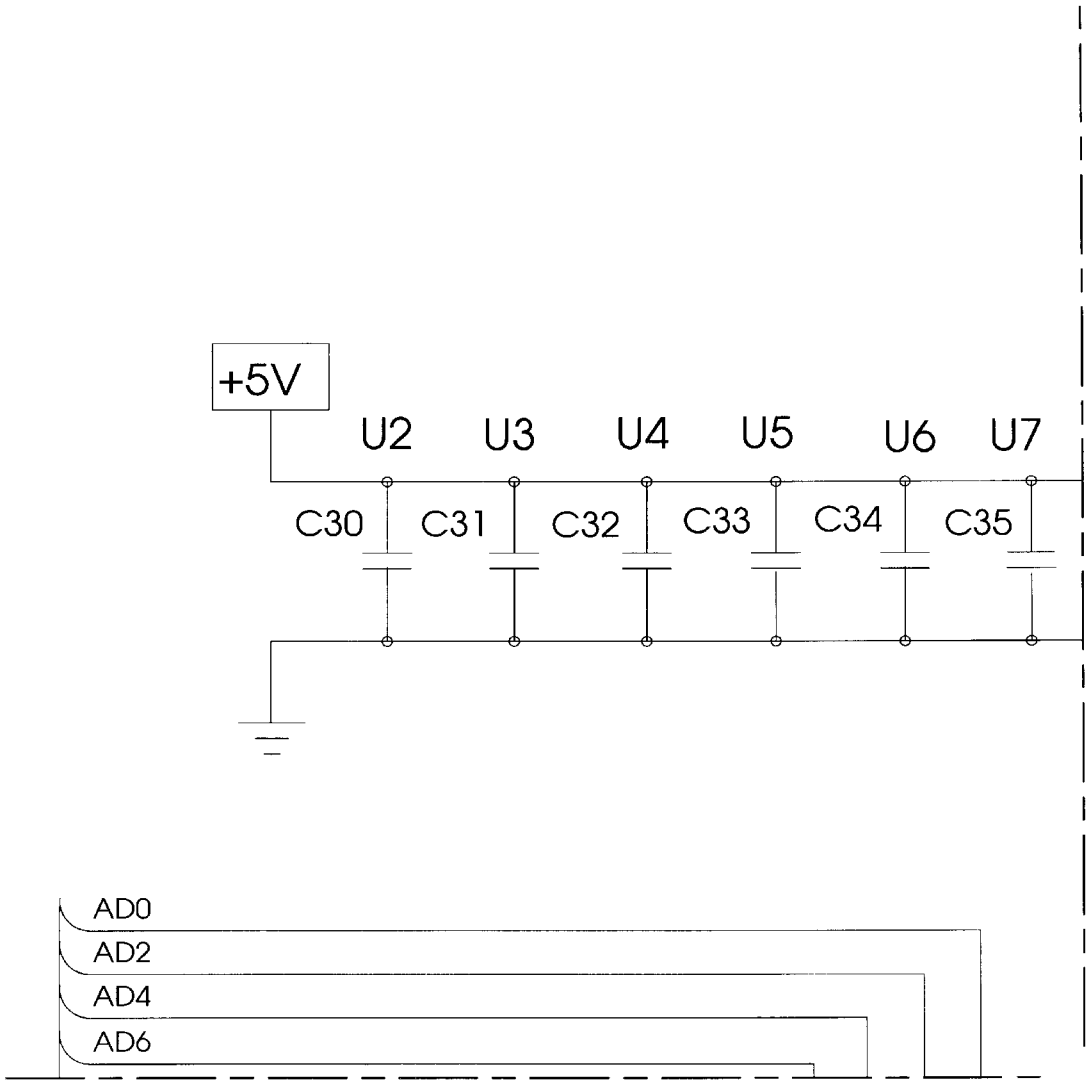
FIG. 8 is a key to FIGS. 8A, 8B, 8C, 8D, 8E, 8F, 8G, 8H, 8J, 8K, 8L, 8M, 8N, 8P, 8Q, 8R, 8S, 8T, 8U, 8V, 8W, 8X, 8Y, 8Z, 8AA, 8AB, 8AC, 8AD, 8AE, 8AF, 8AG and 8AH, which are schematic diagrams of the electronic components of the improved control system.
Figure 8B:
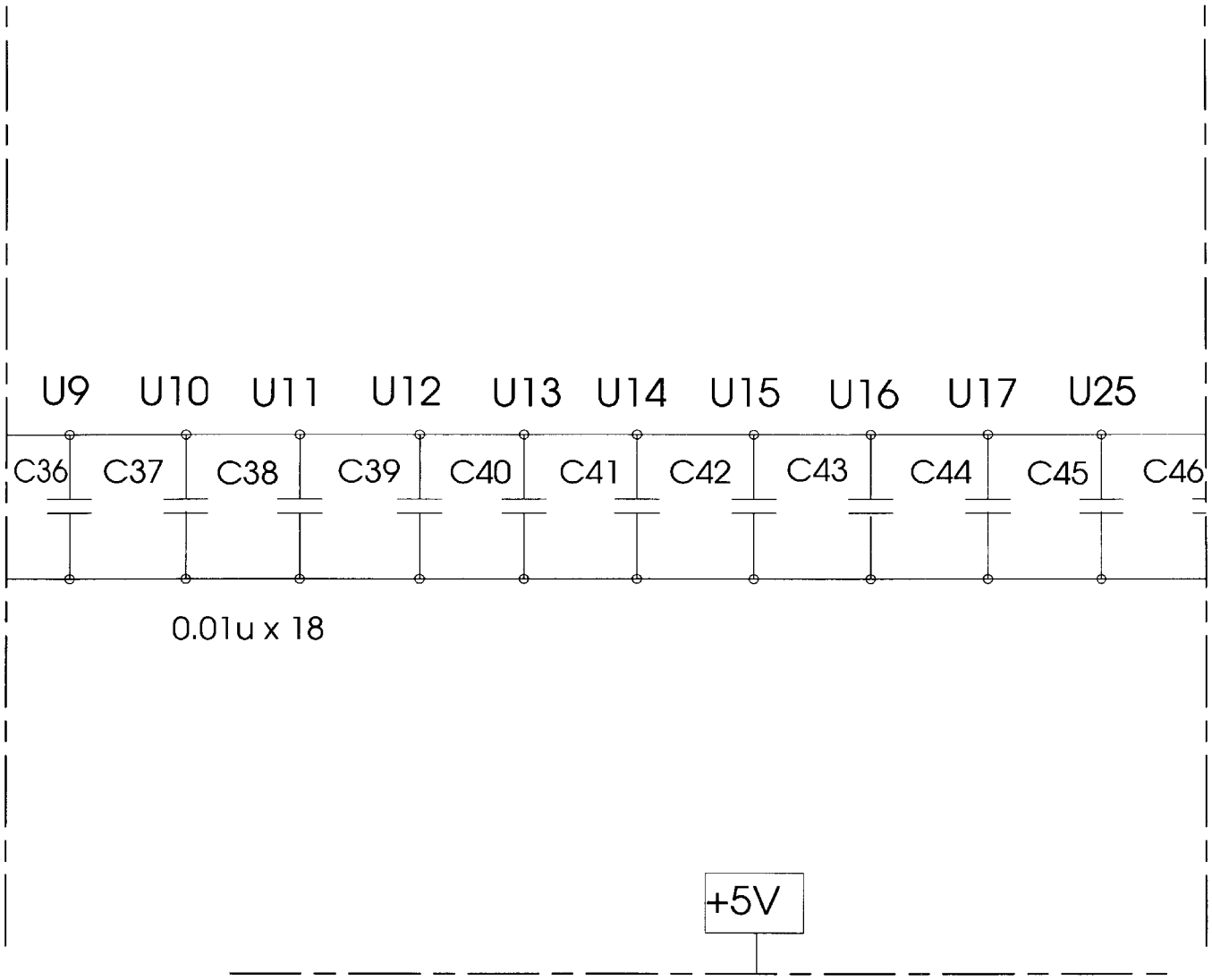
Figure 8C:
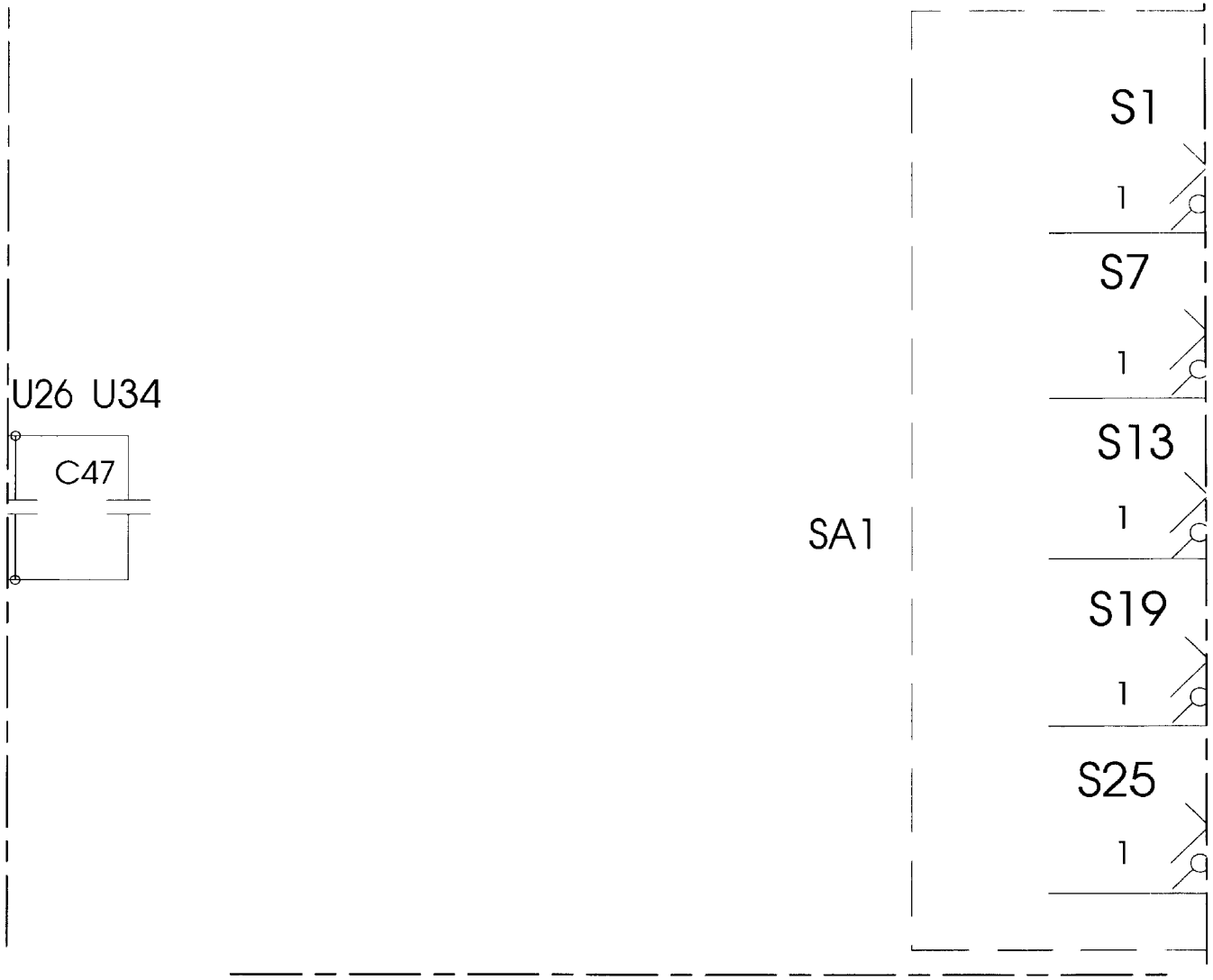
Figure 8D:
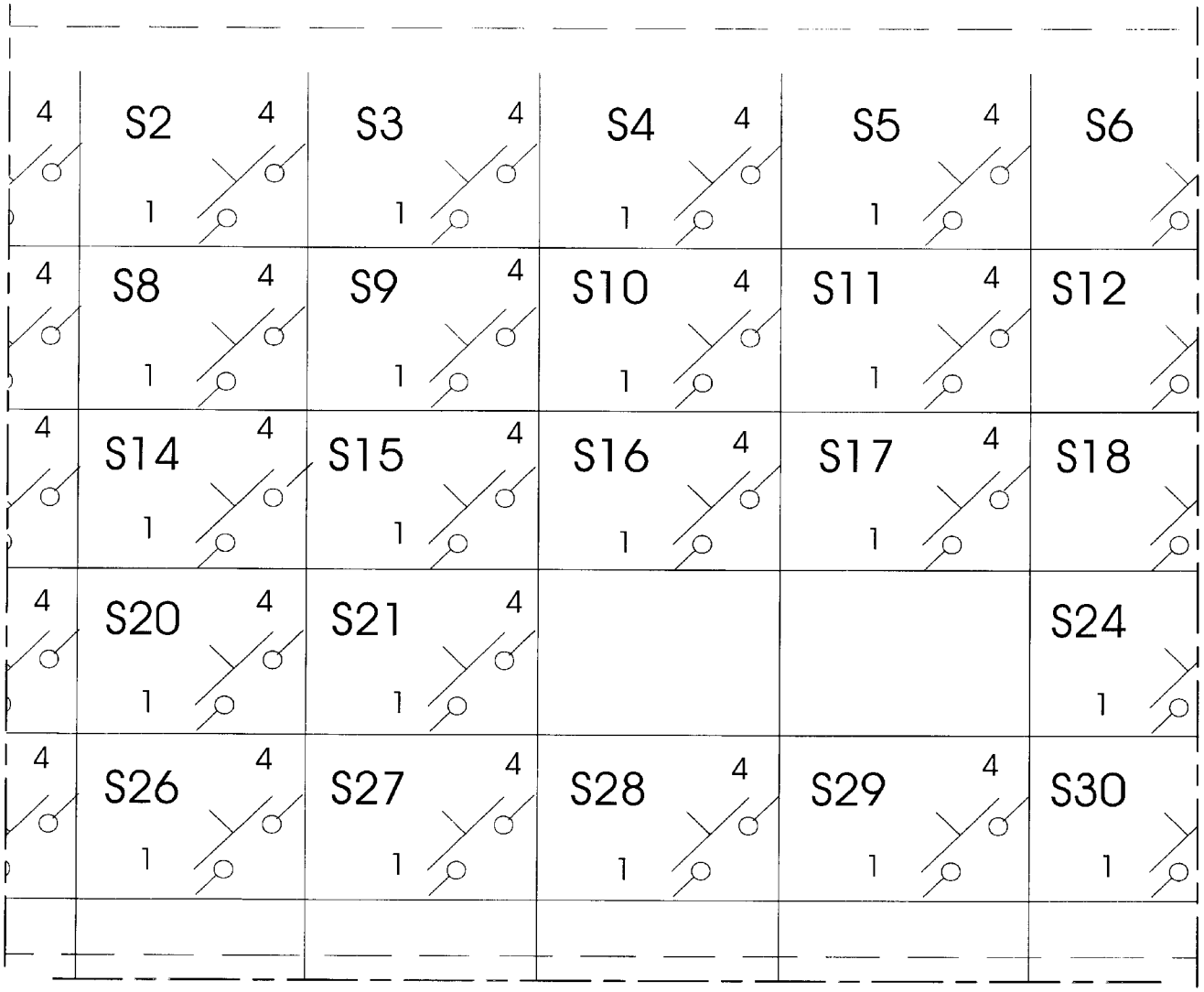
Figure 8E:
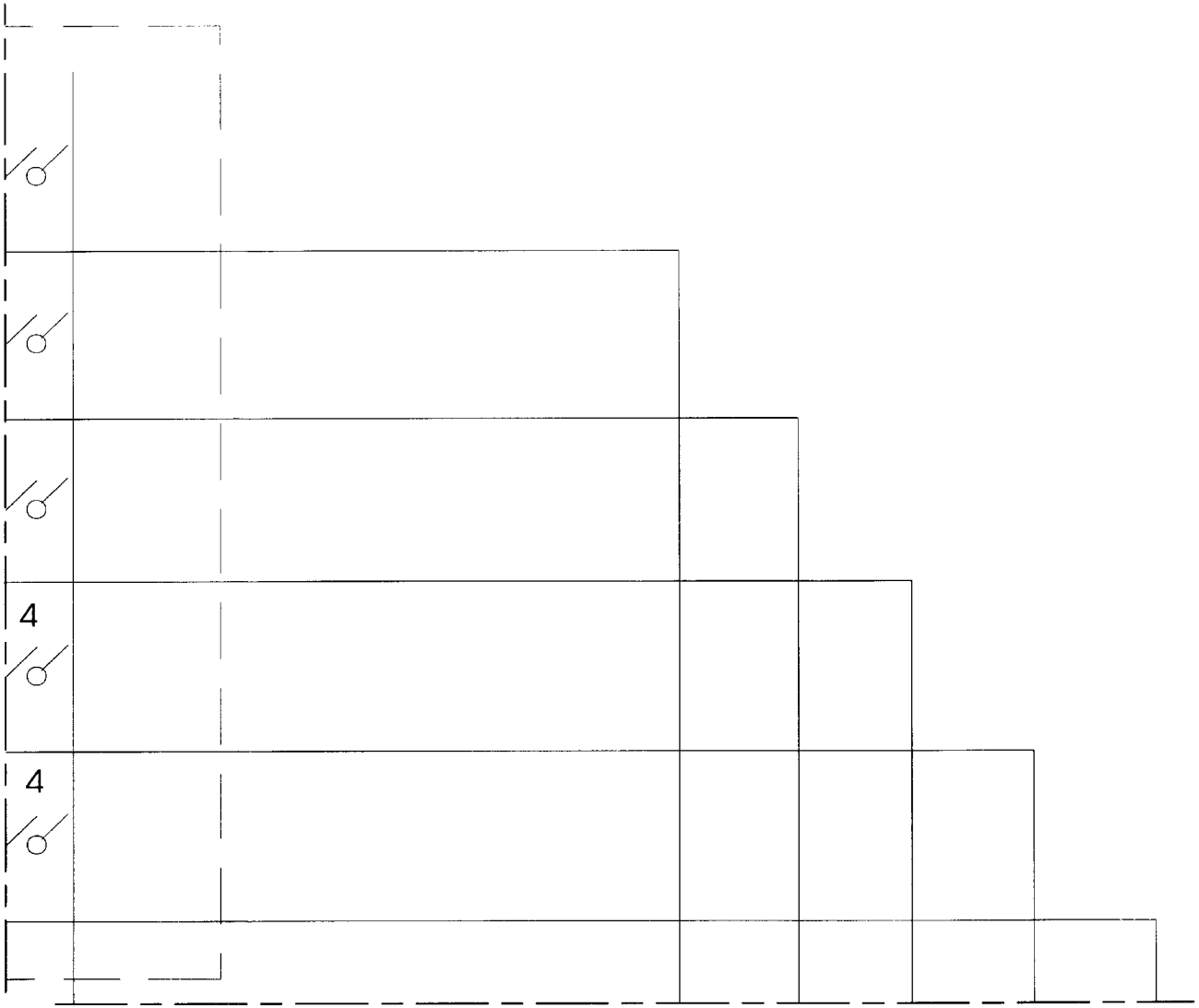
Figure 8F:
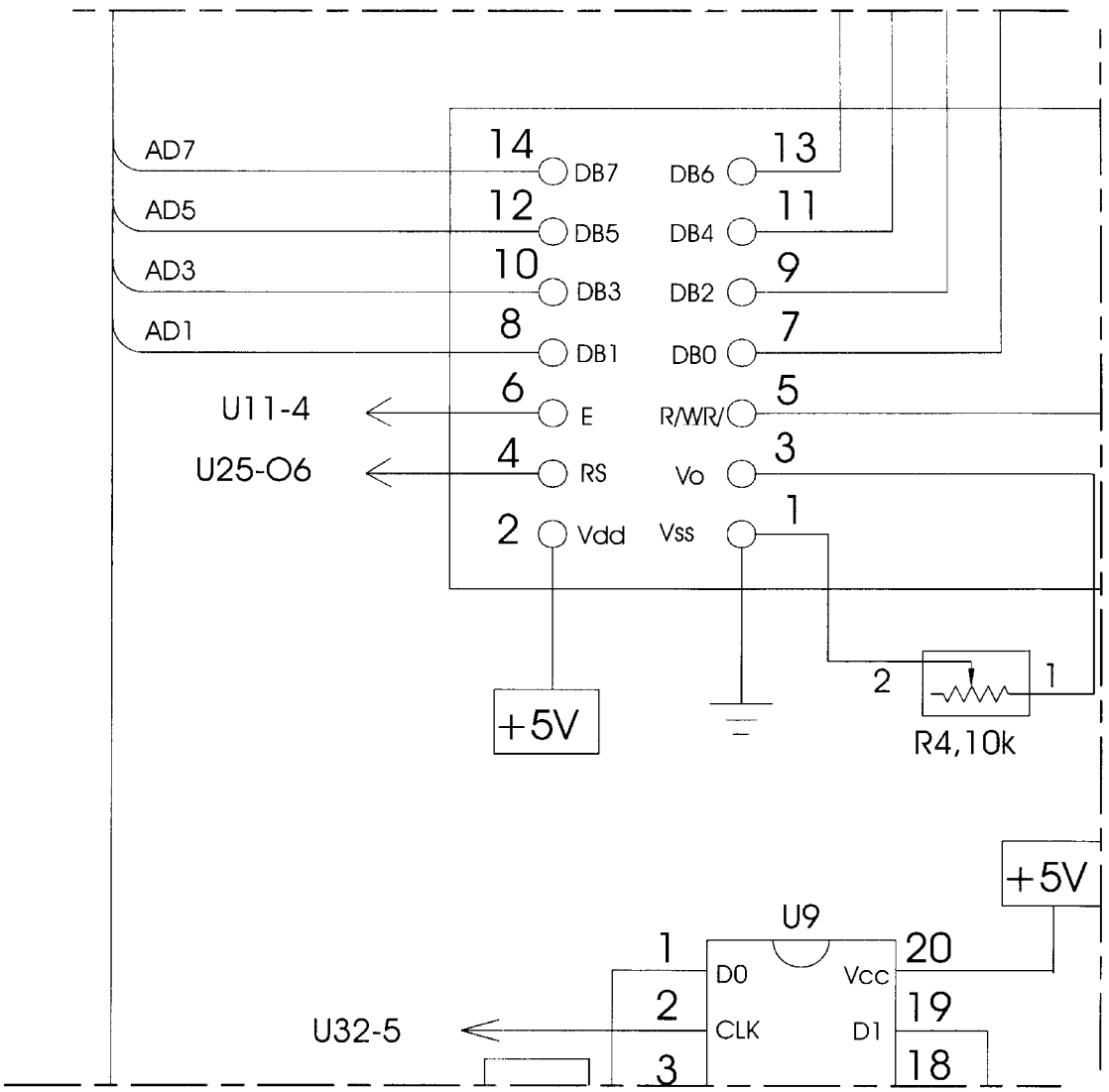
Figure 8G:
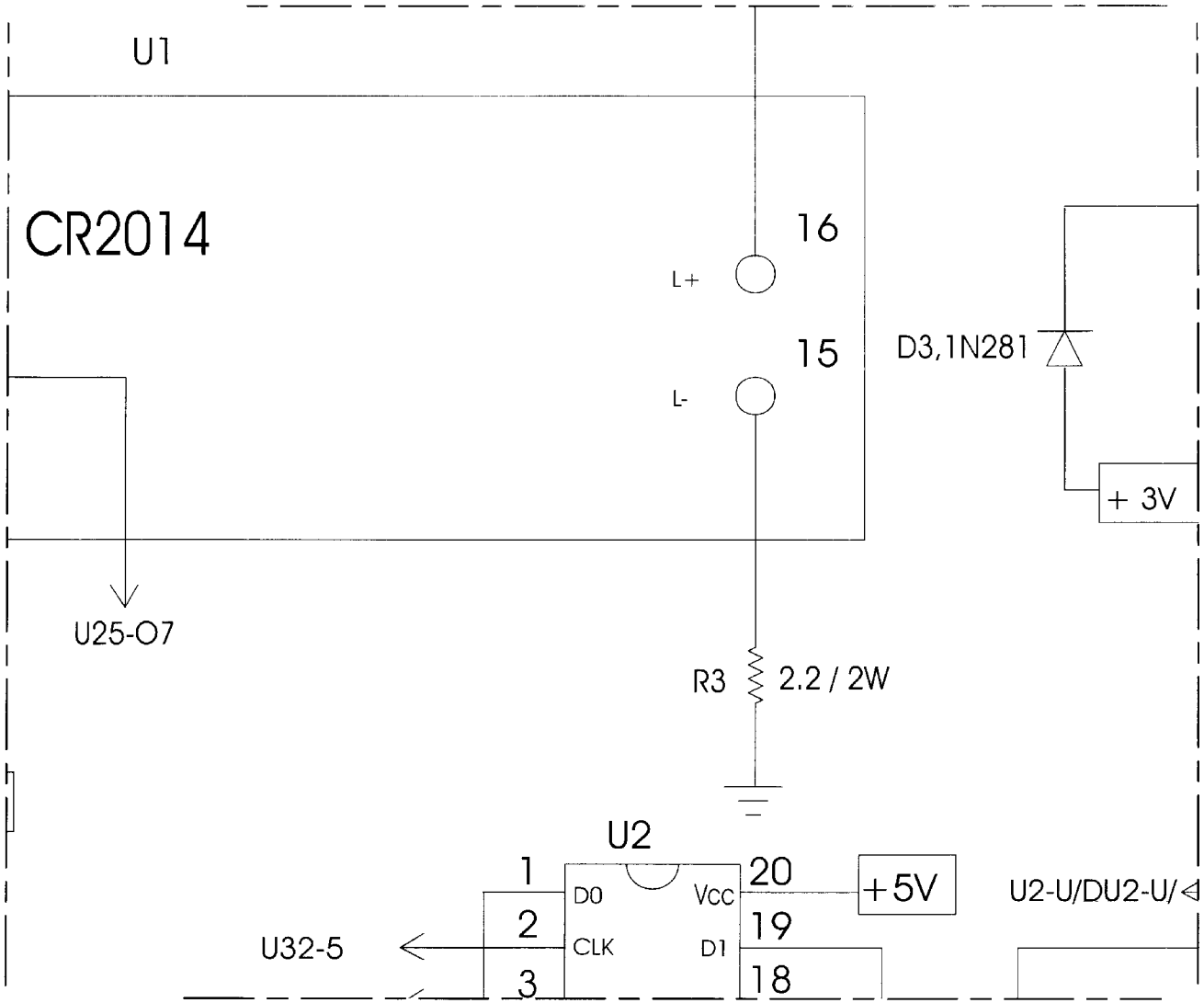
Figure 8H:
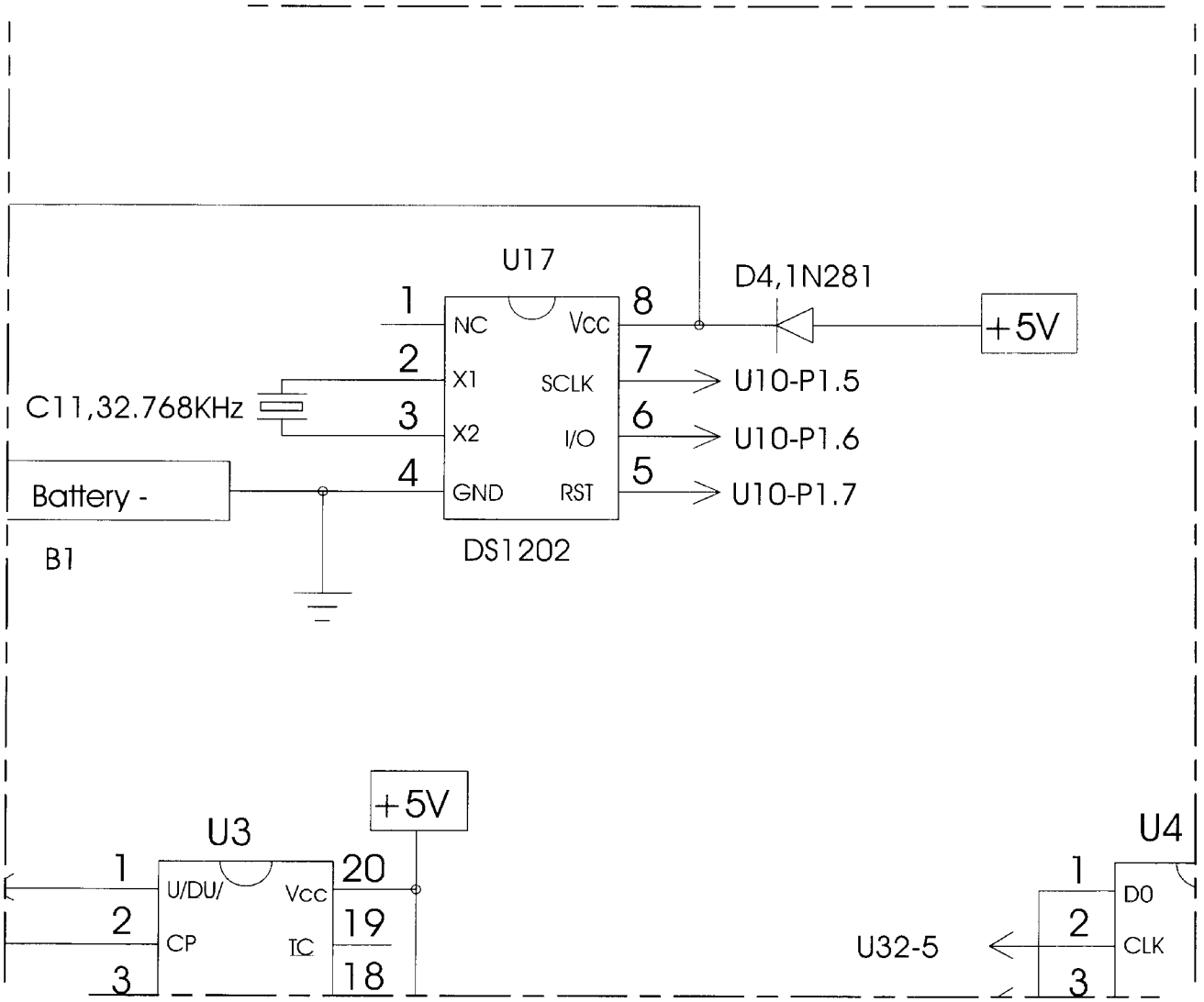
Figure 8J:
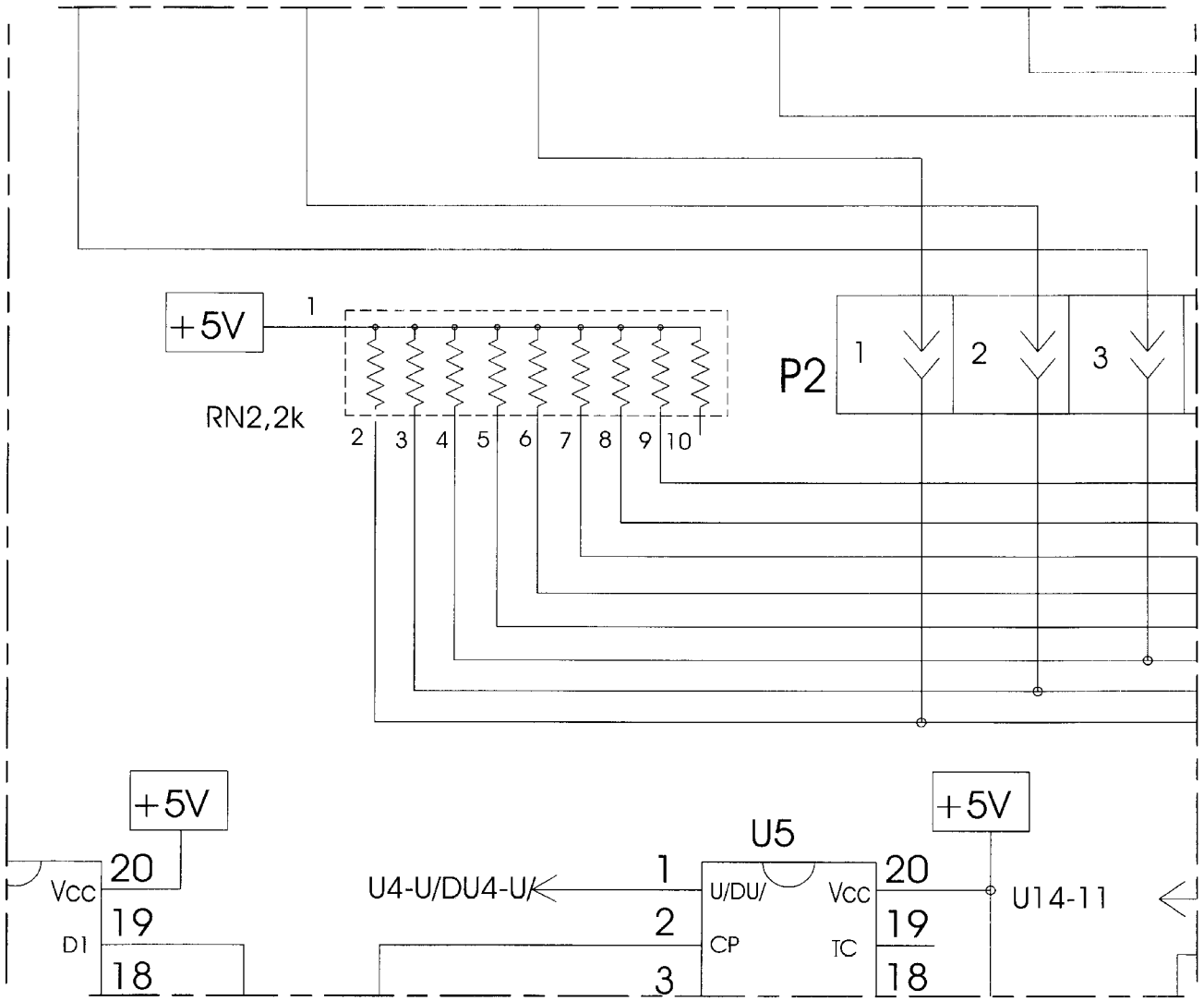
Figure 8K:
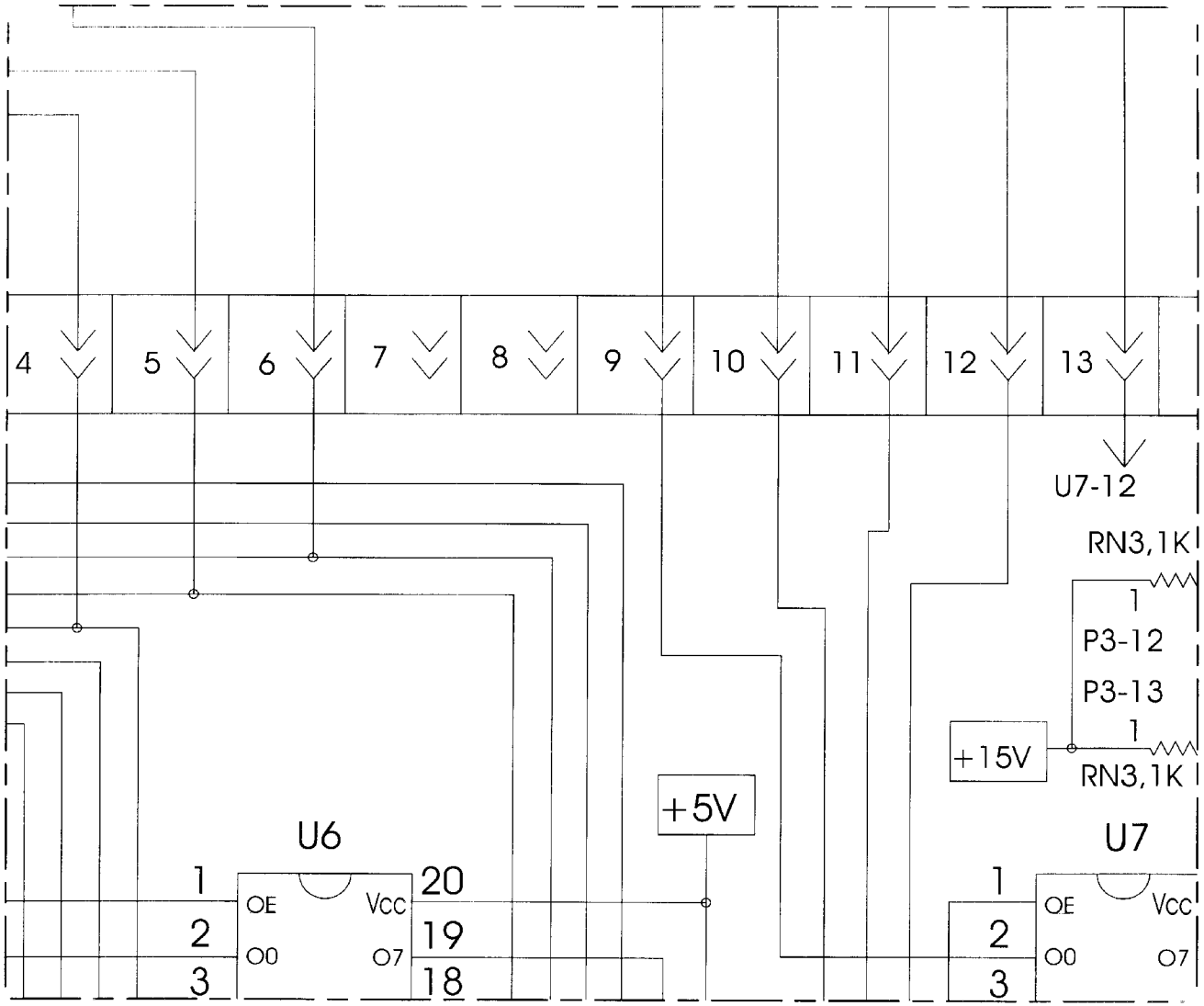
Figure 8L:
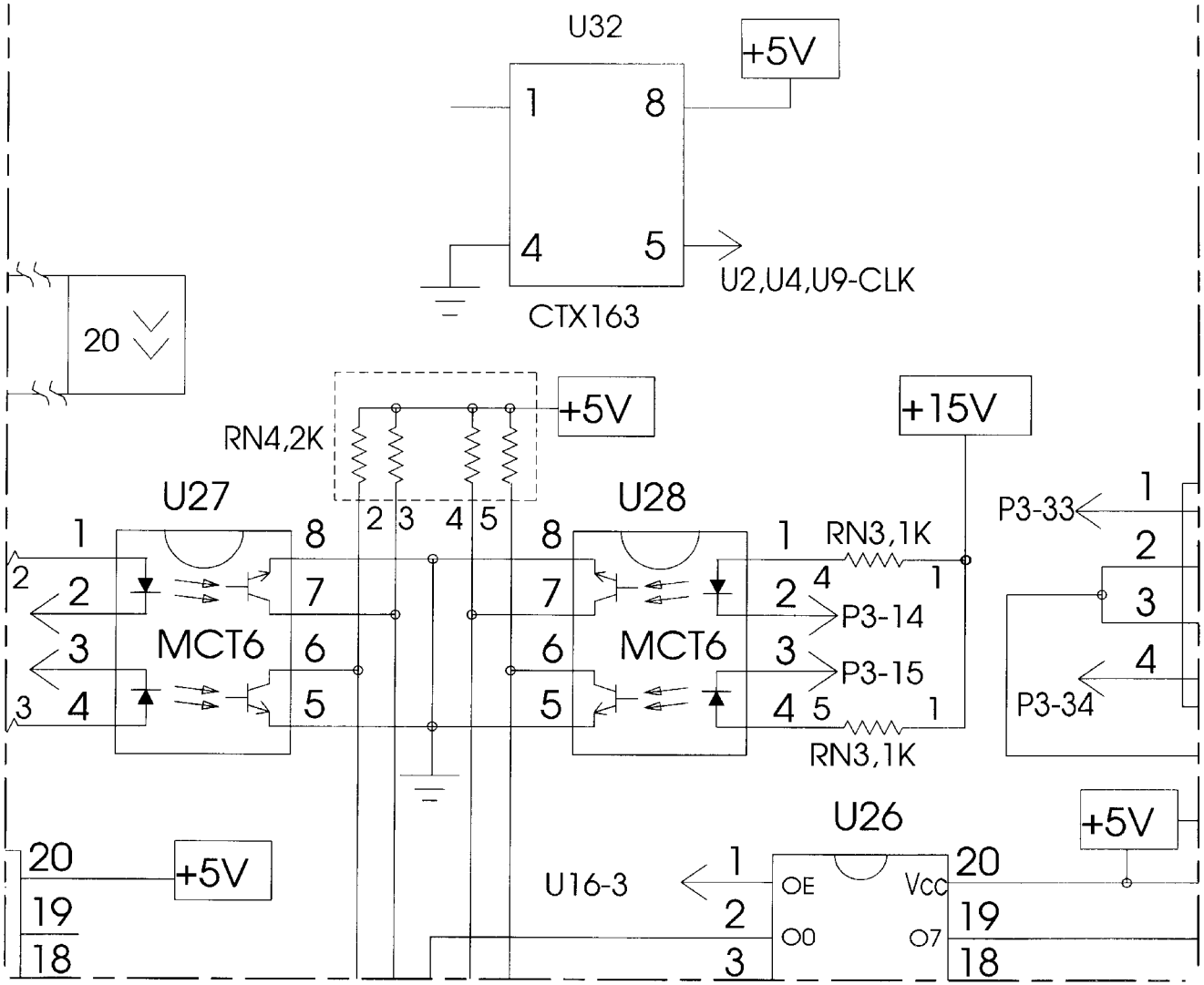
Figure 8M:
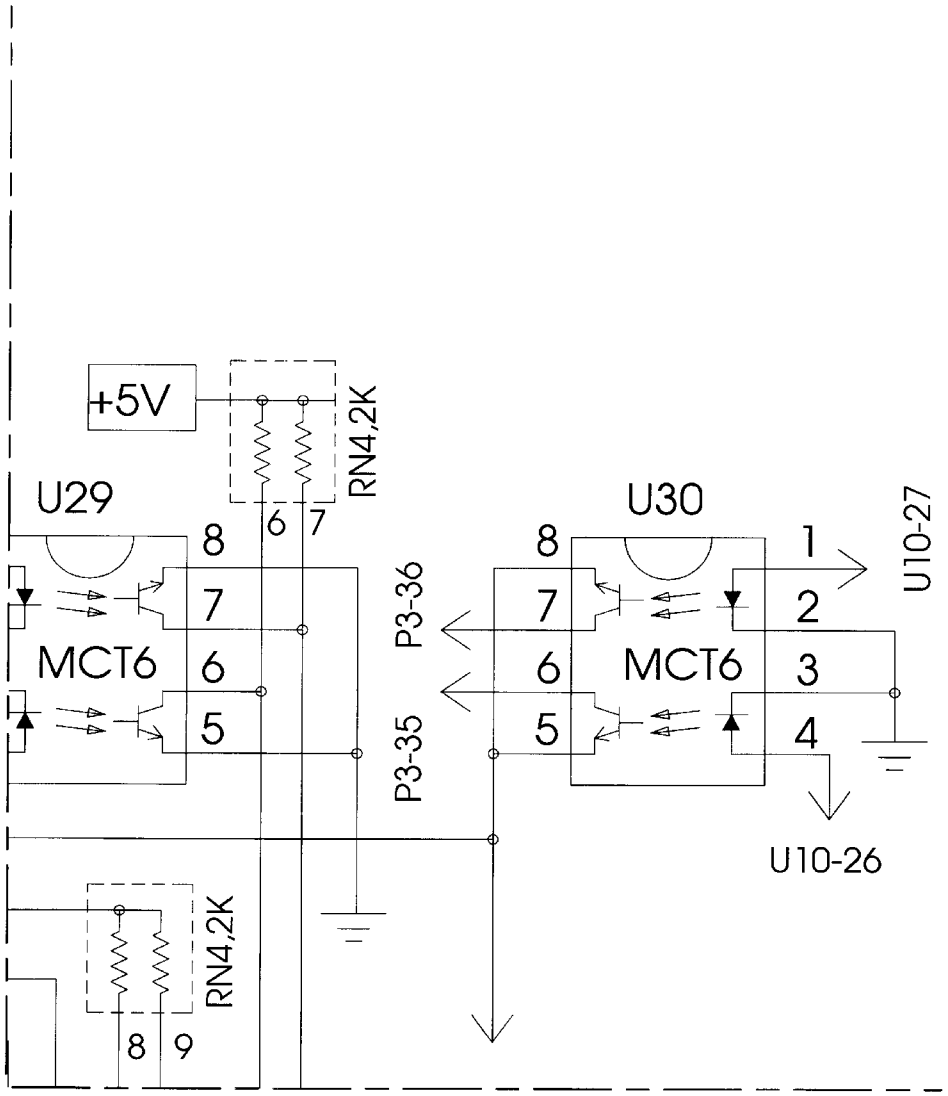
Figure 8N:
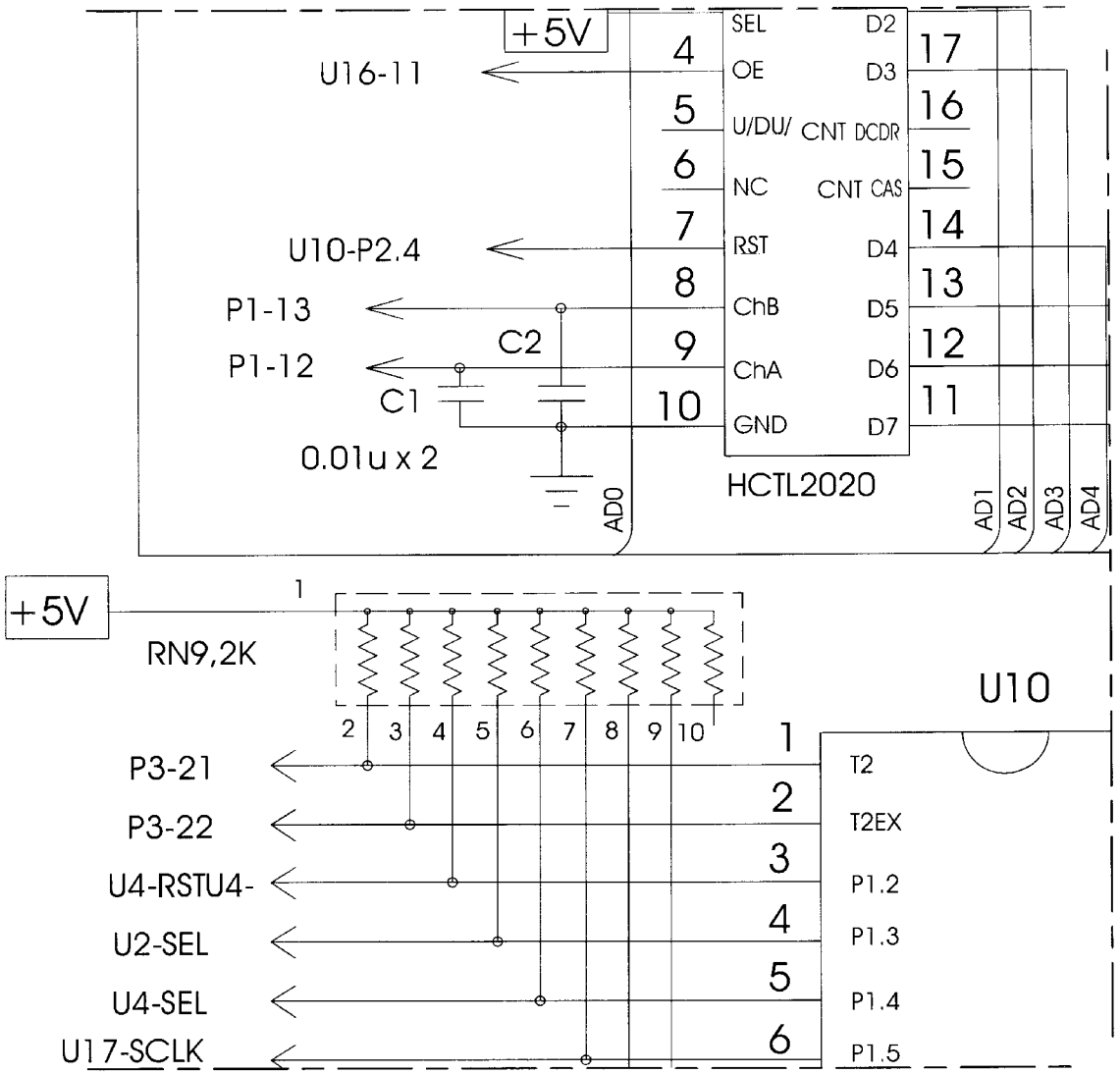
Figure 8P:
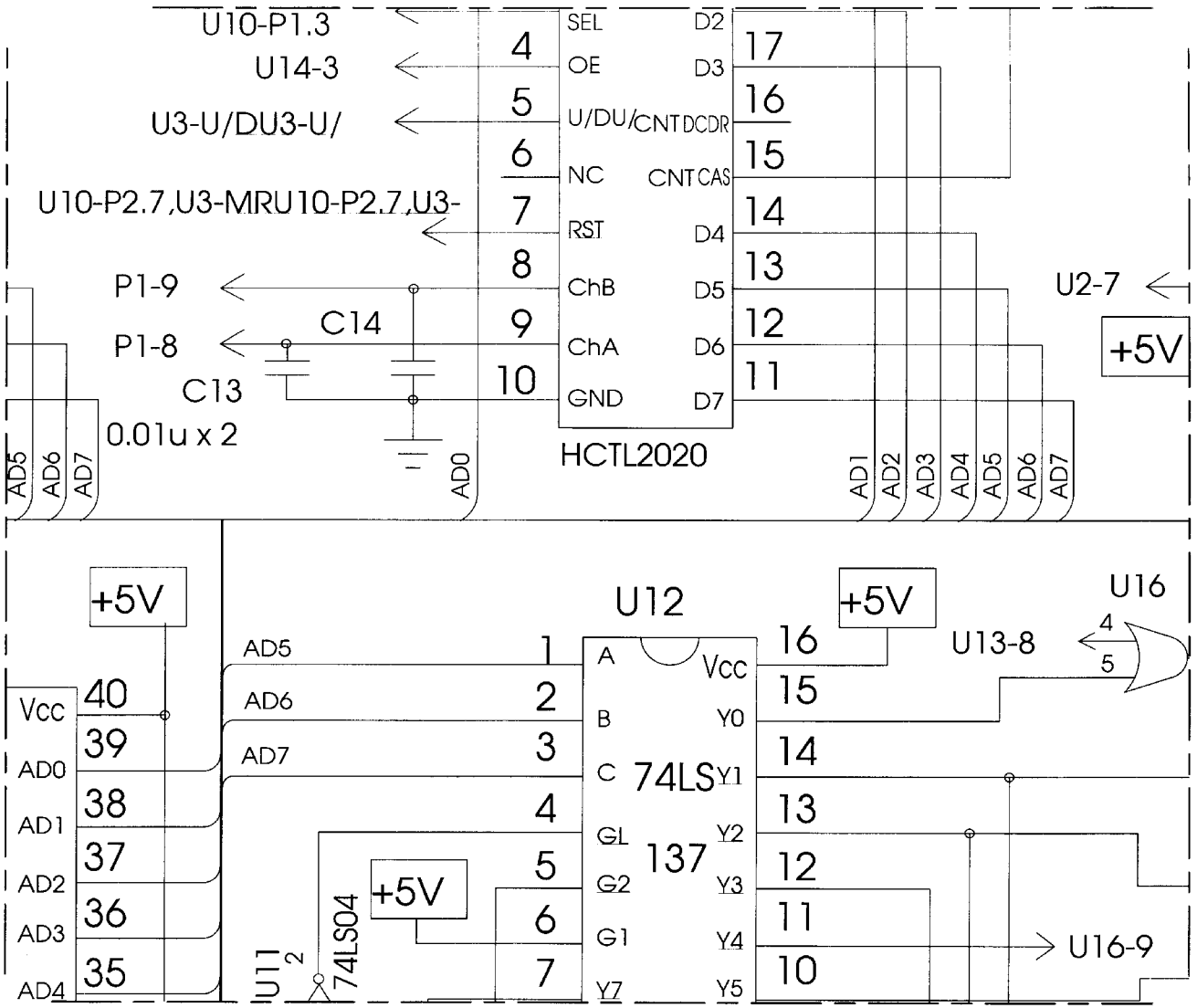
Figure 8Q:
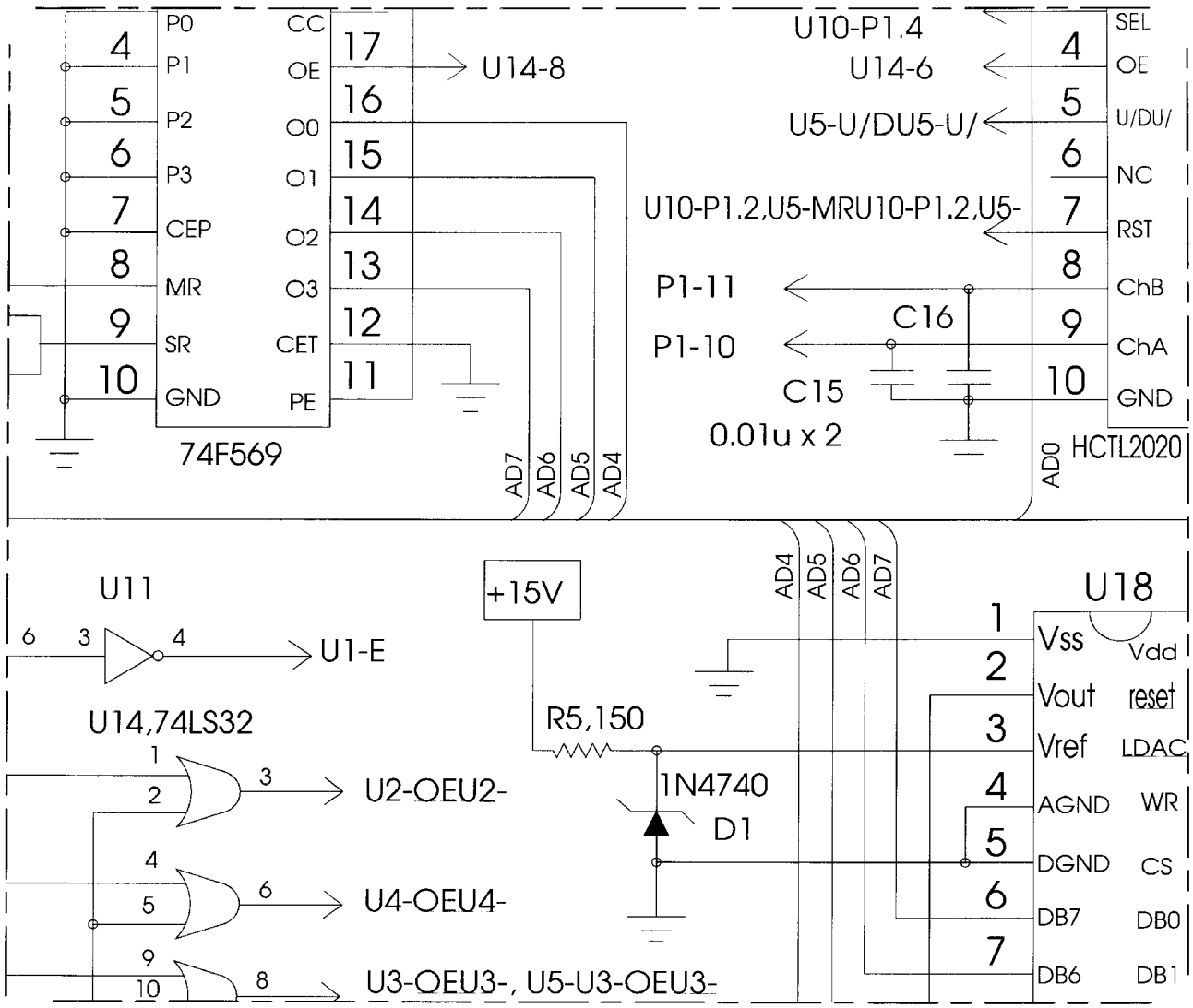
Figure 8R:
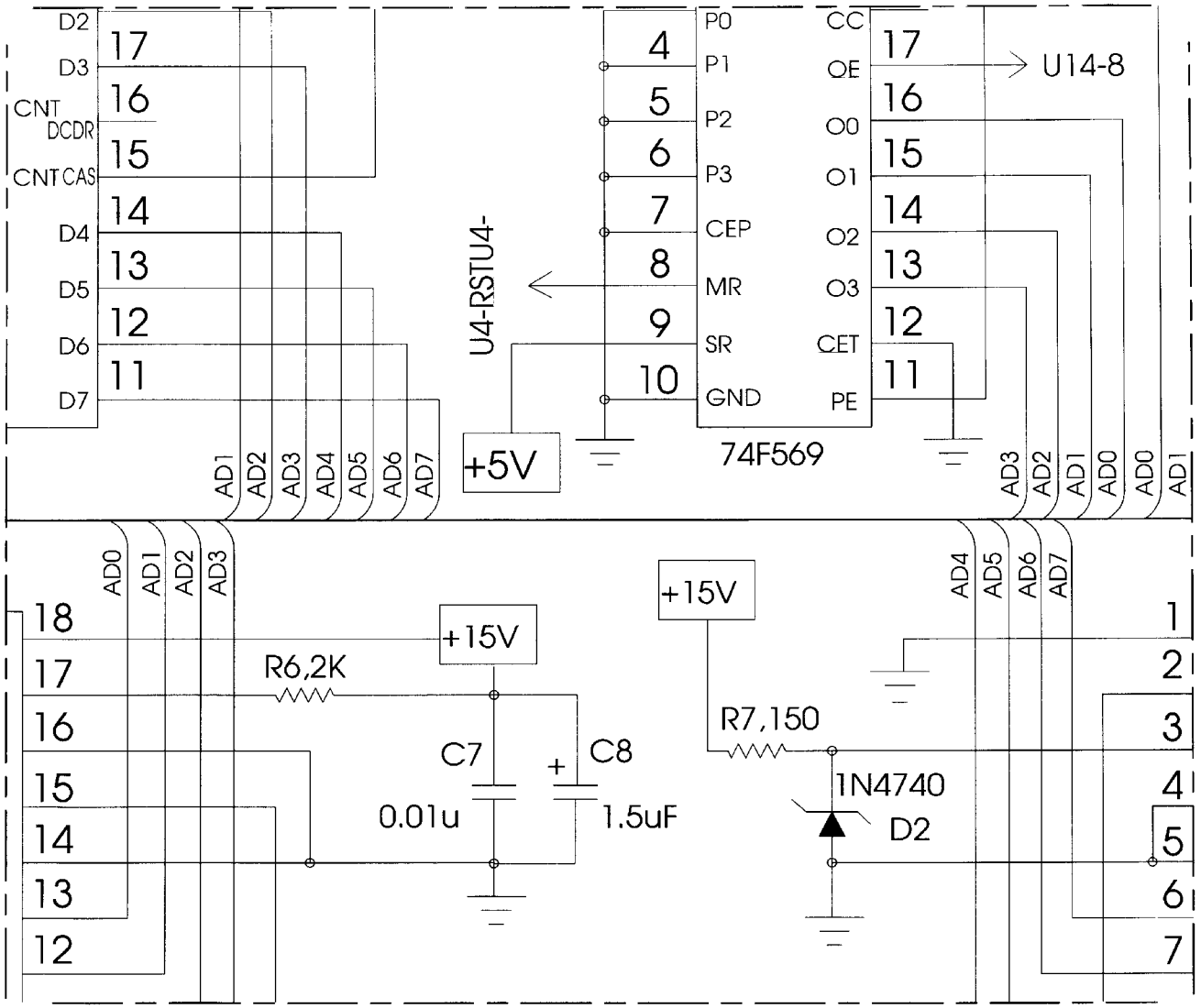
Figure 8S:
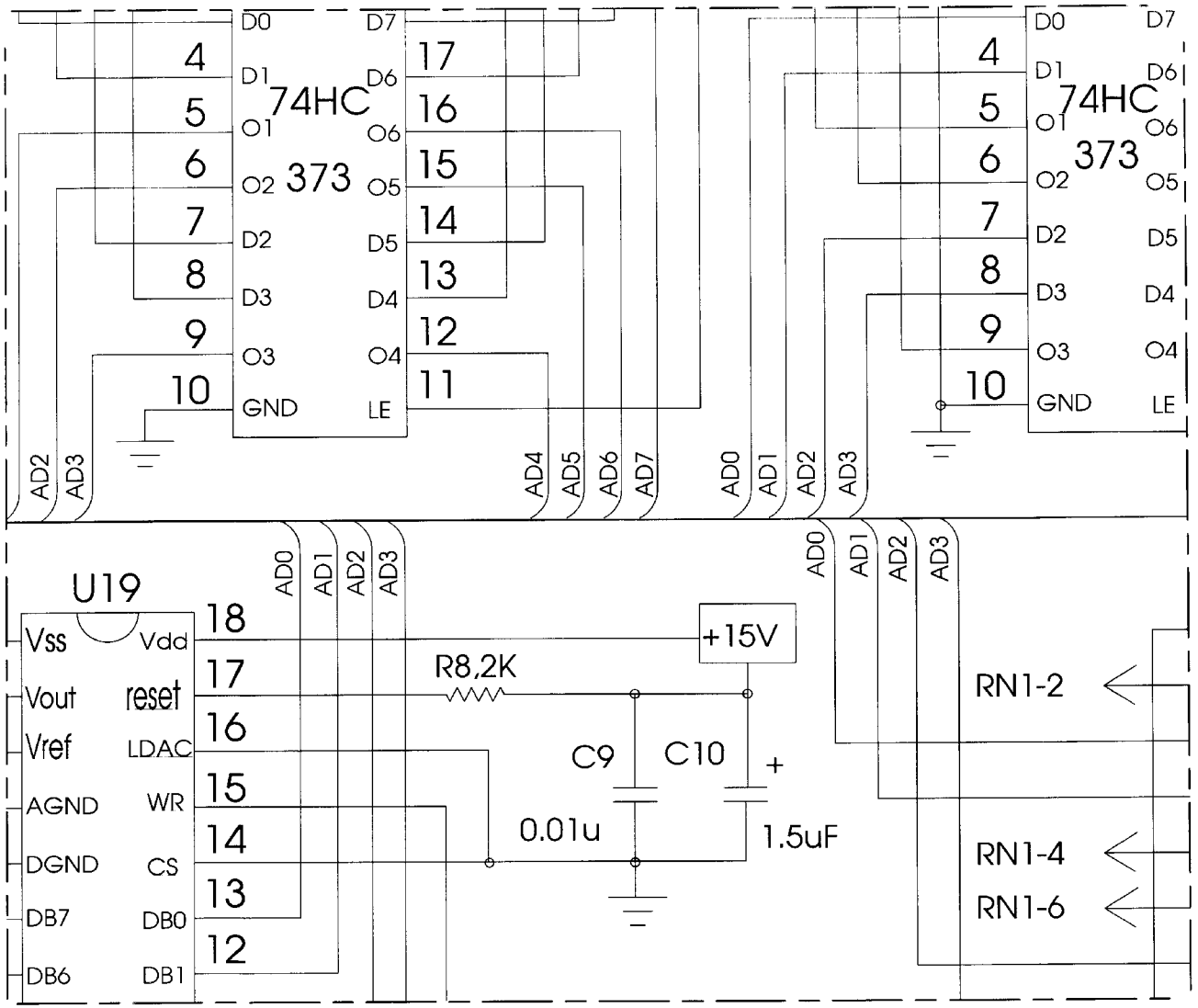
Figure 8T:
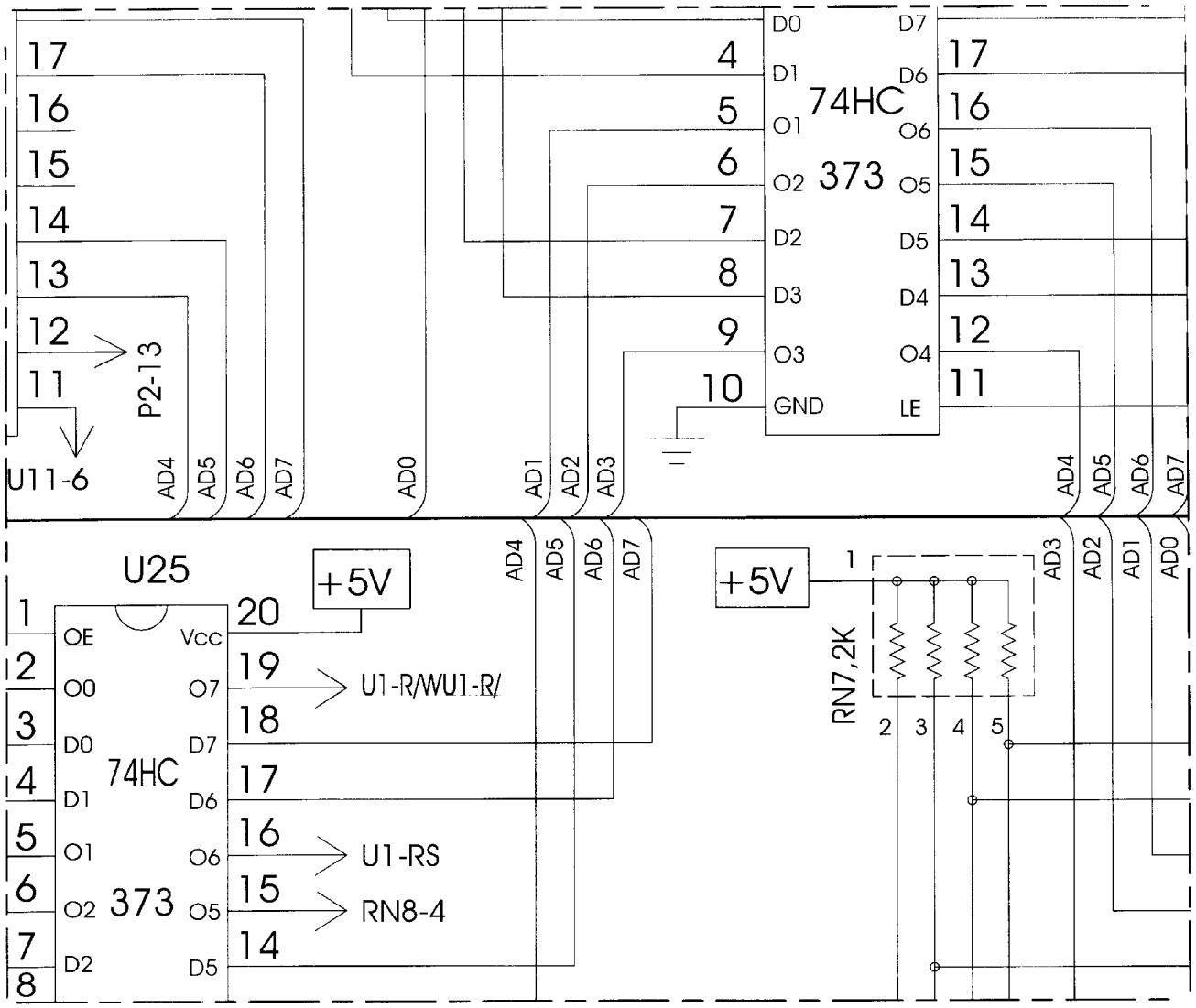
Figure 8U:
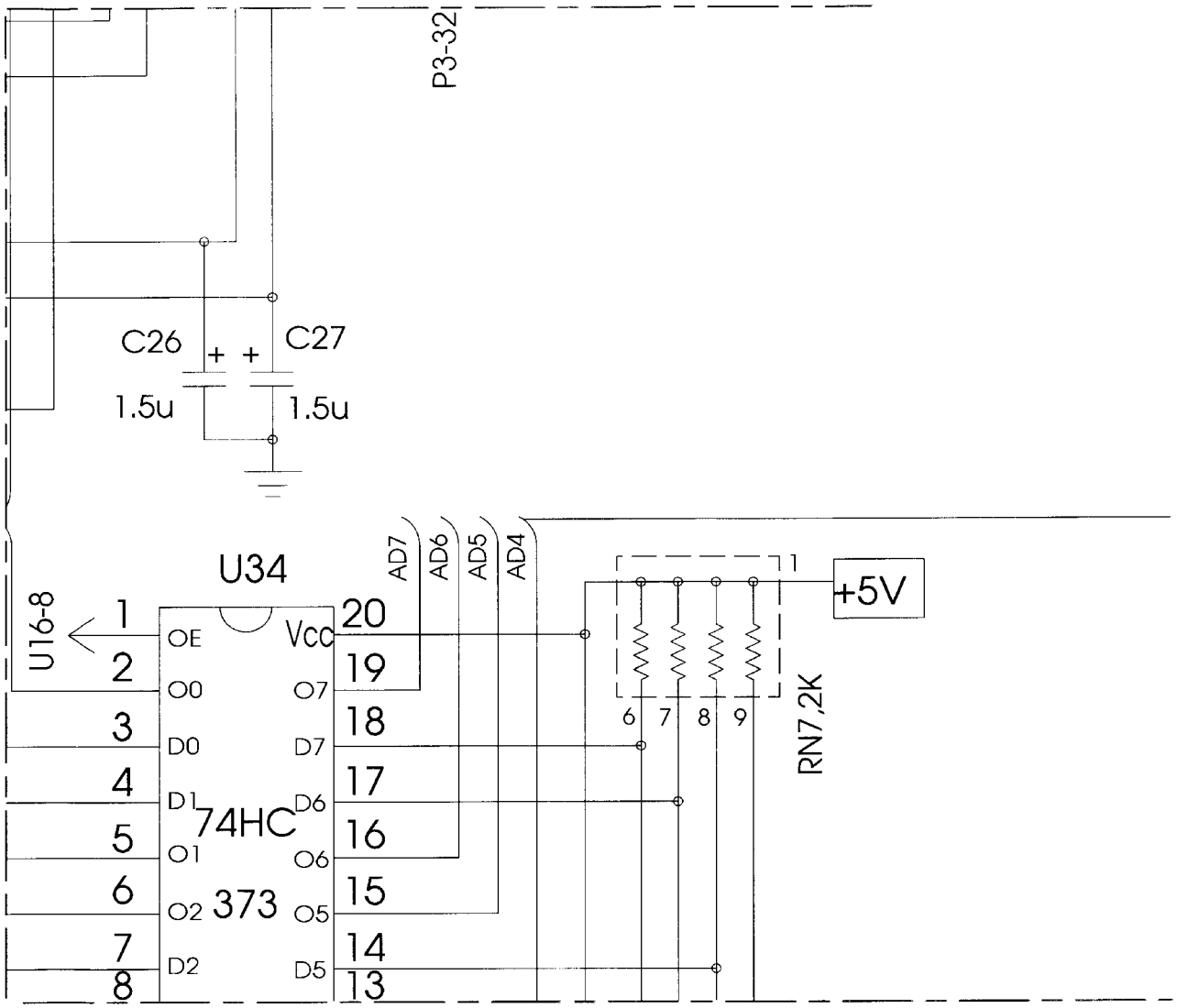
Figure 8V:
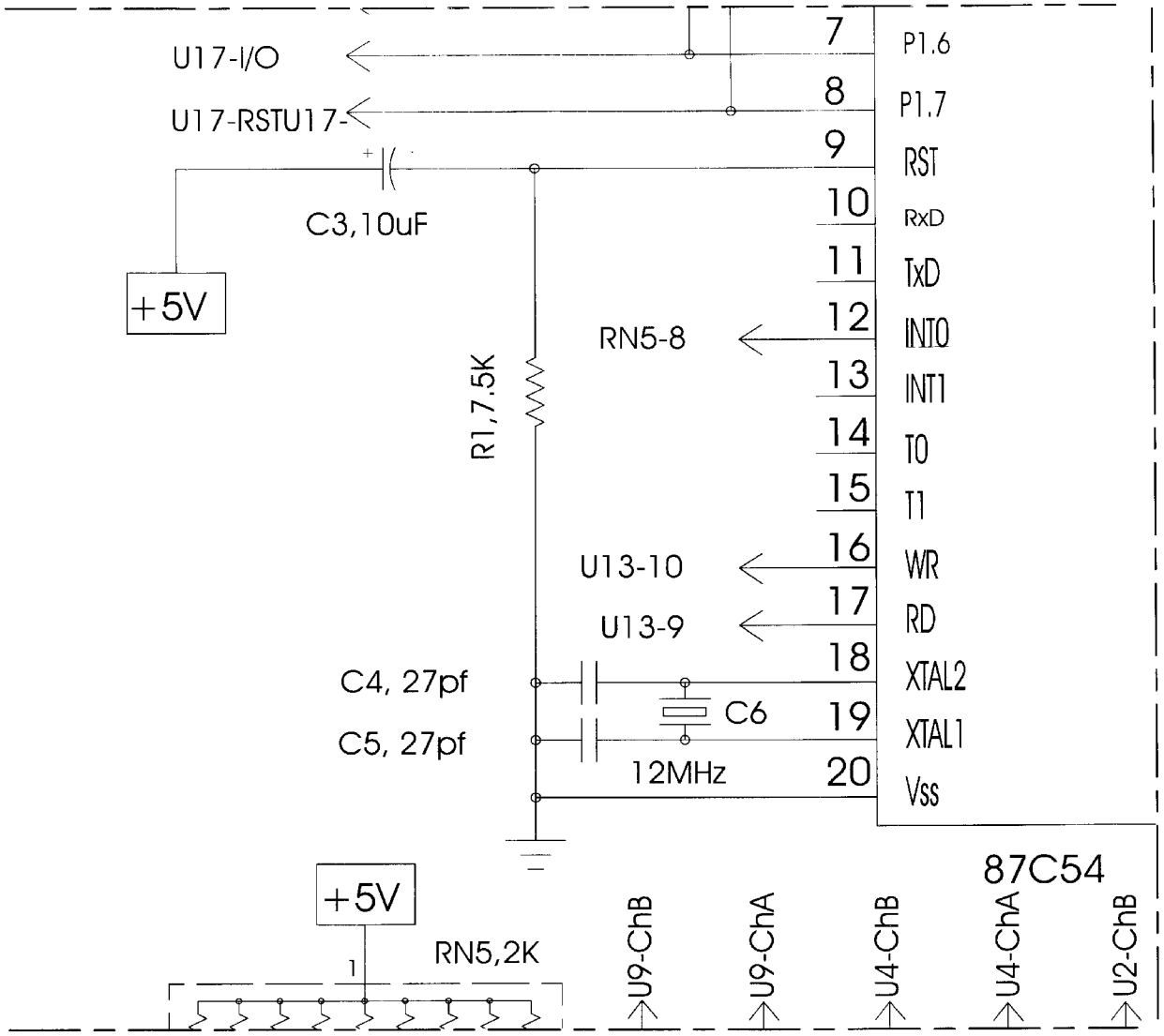
Figure 8W:
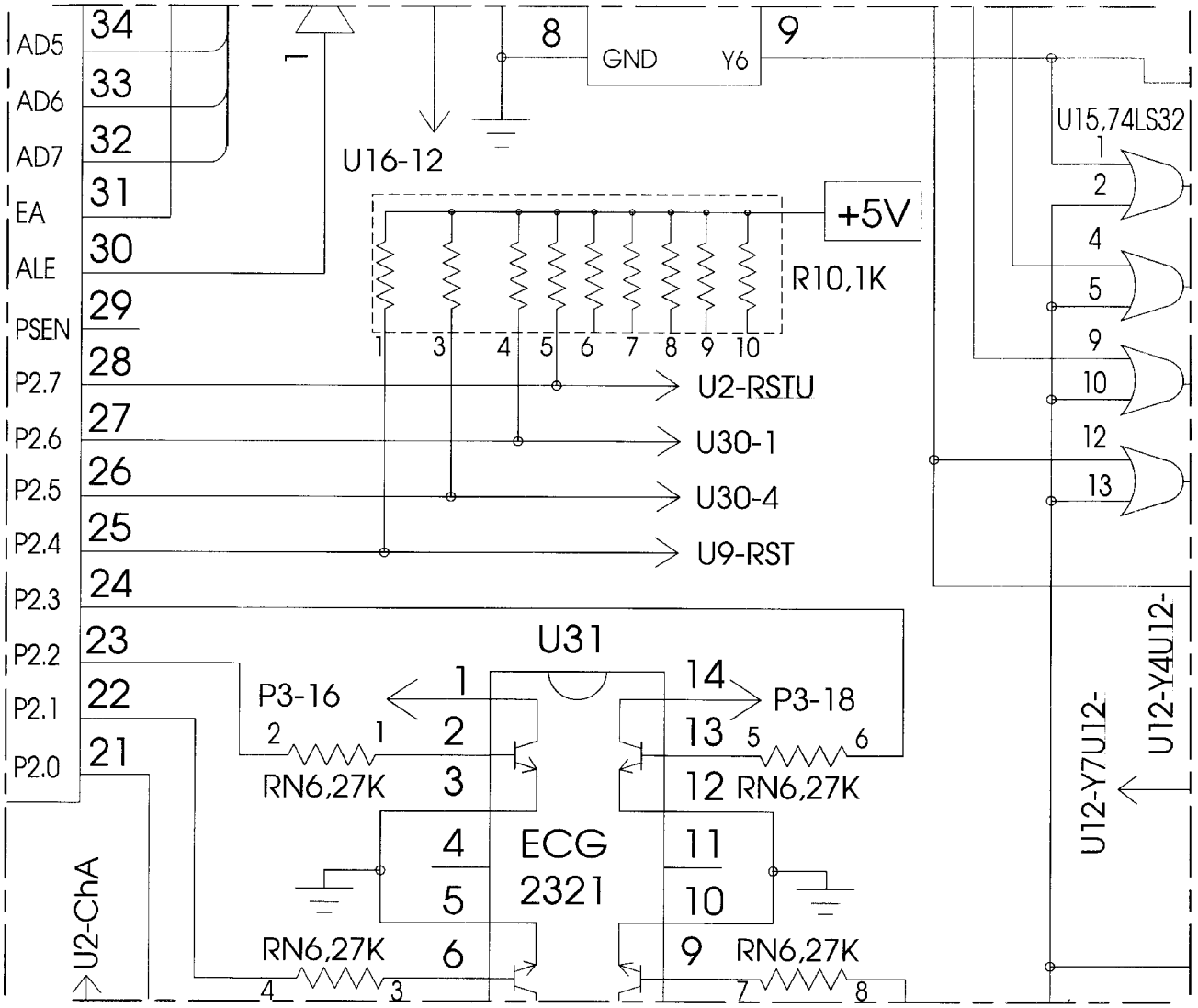
Figure 8X:
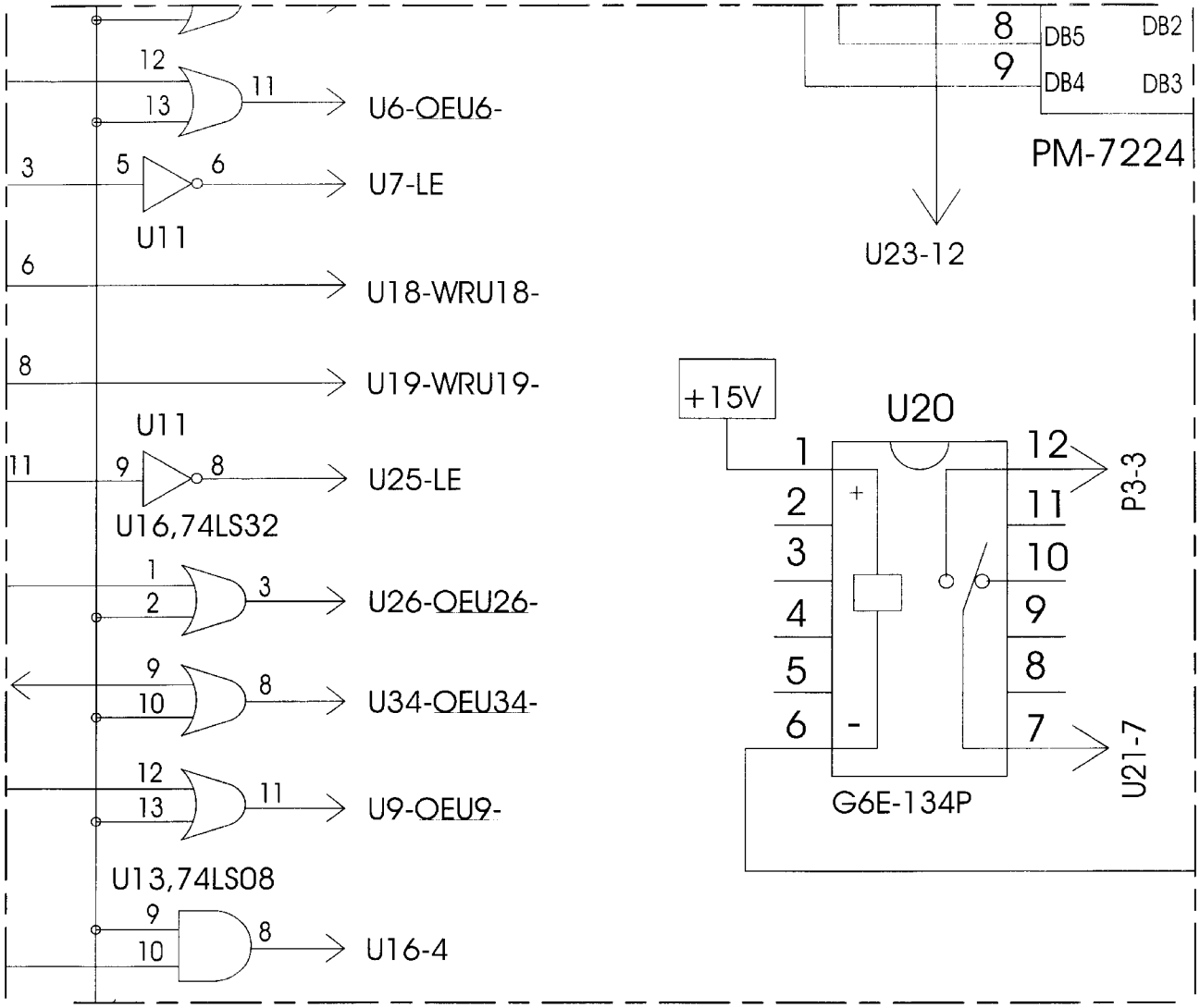
Figure 8Y:
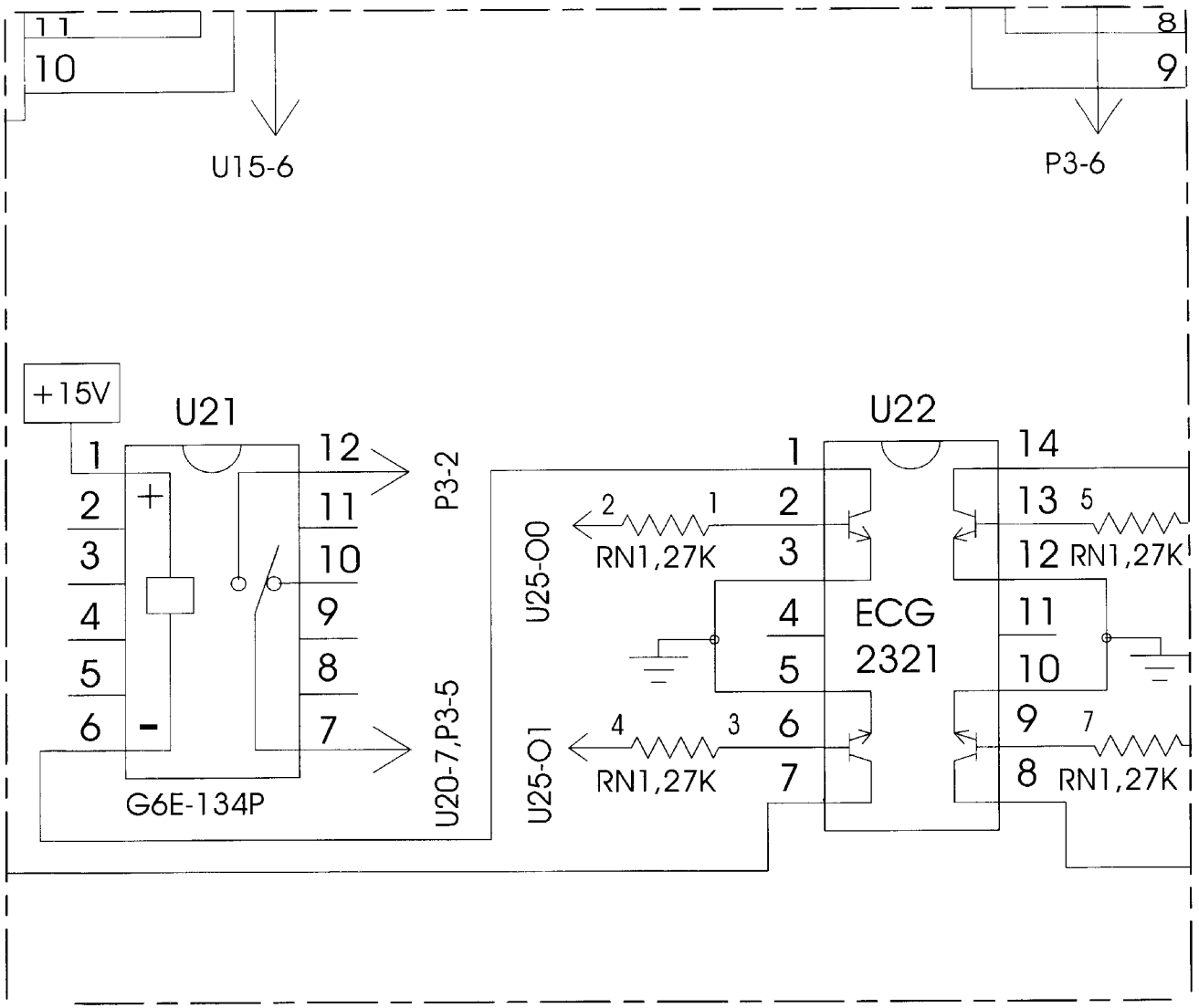
Figure 8Z:
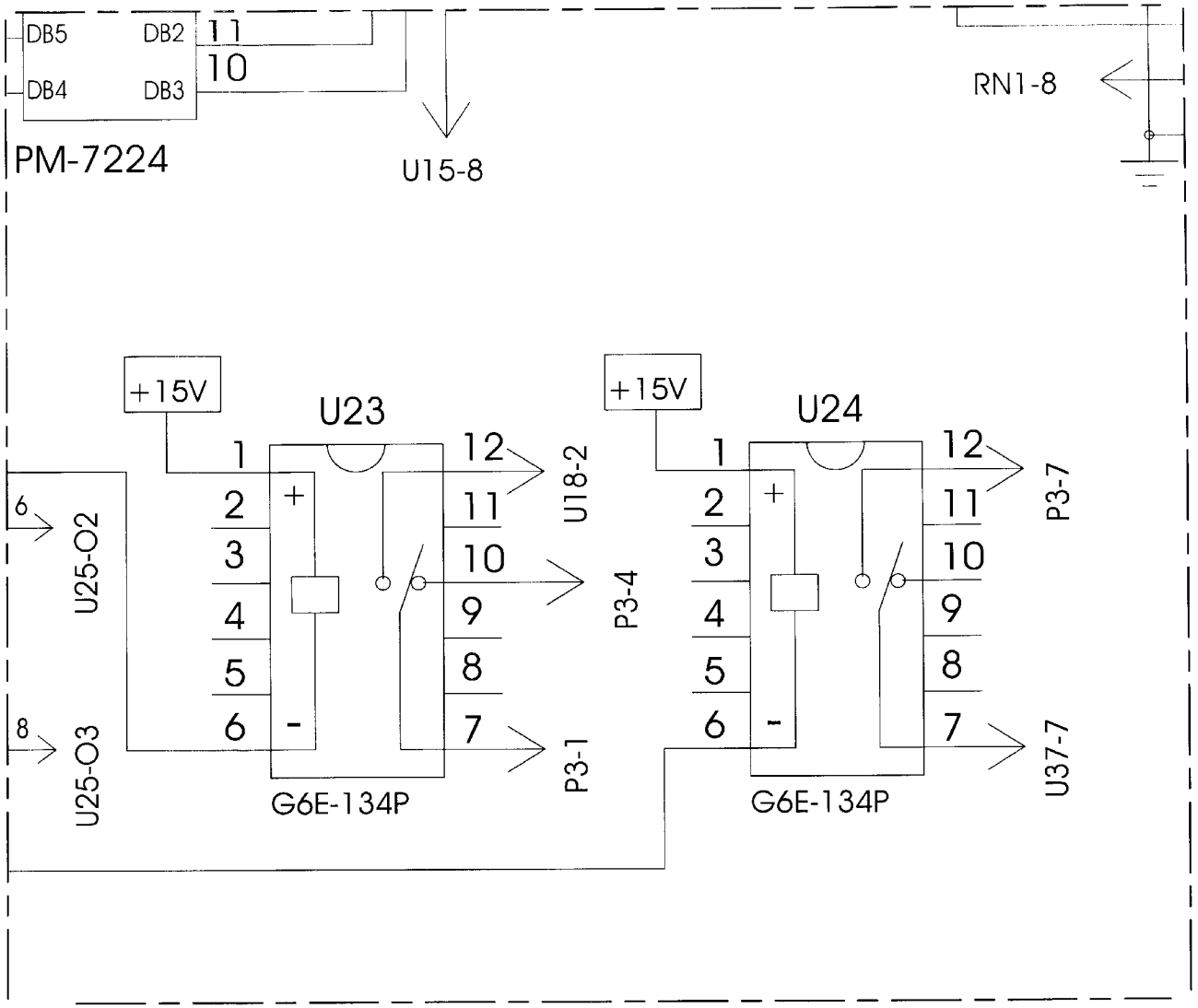
Figure 8A:
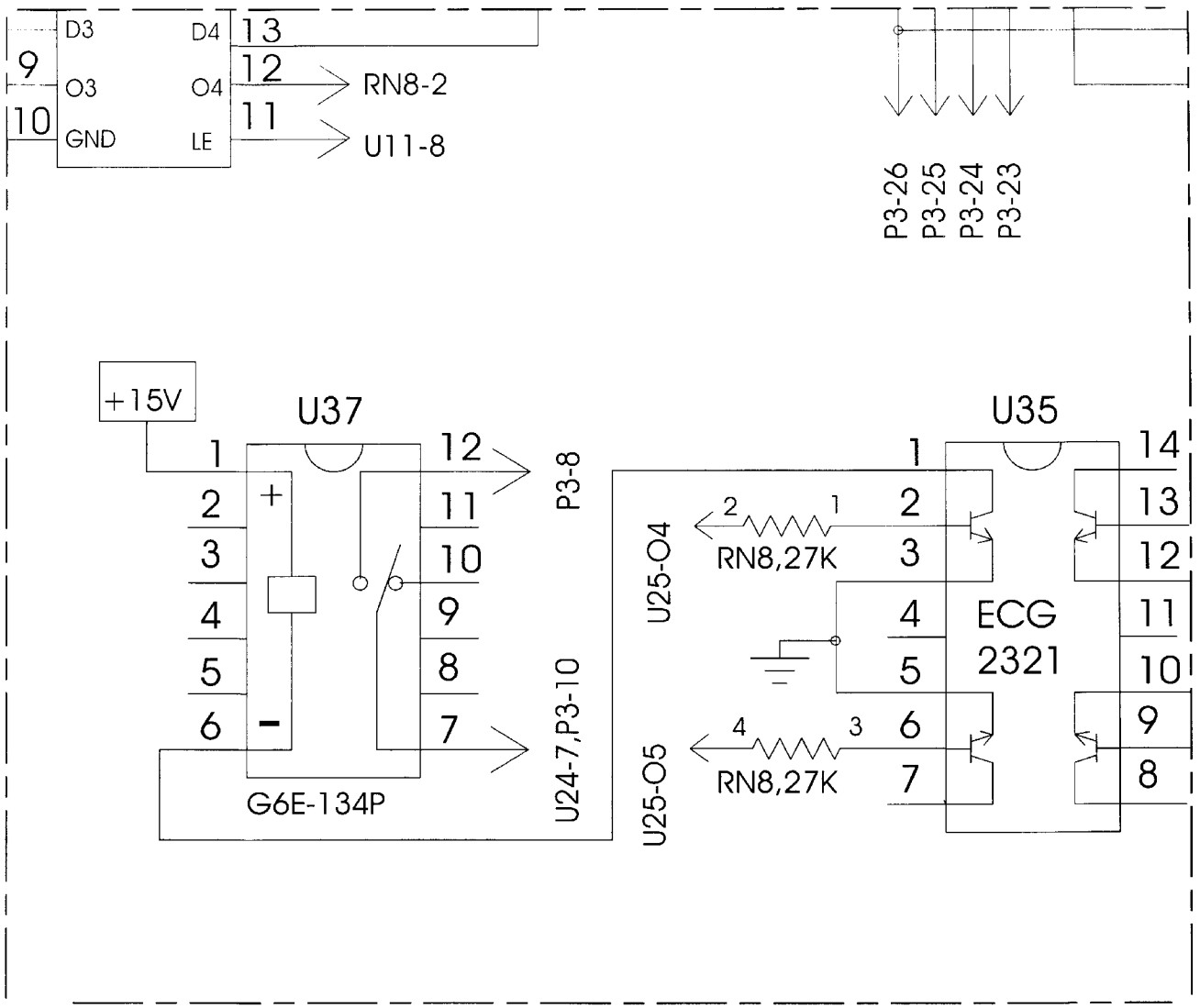
Figure 8A:
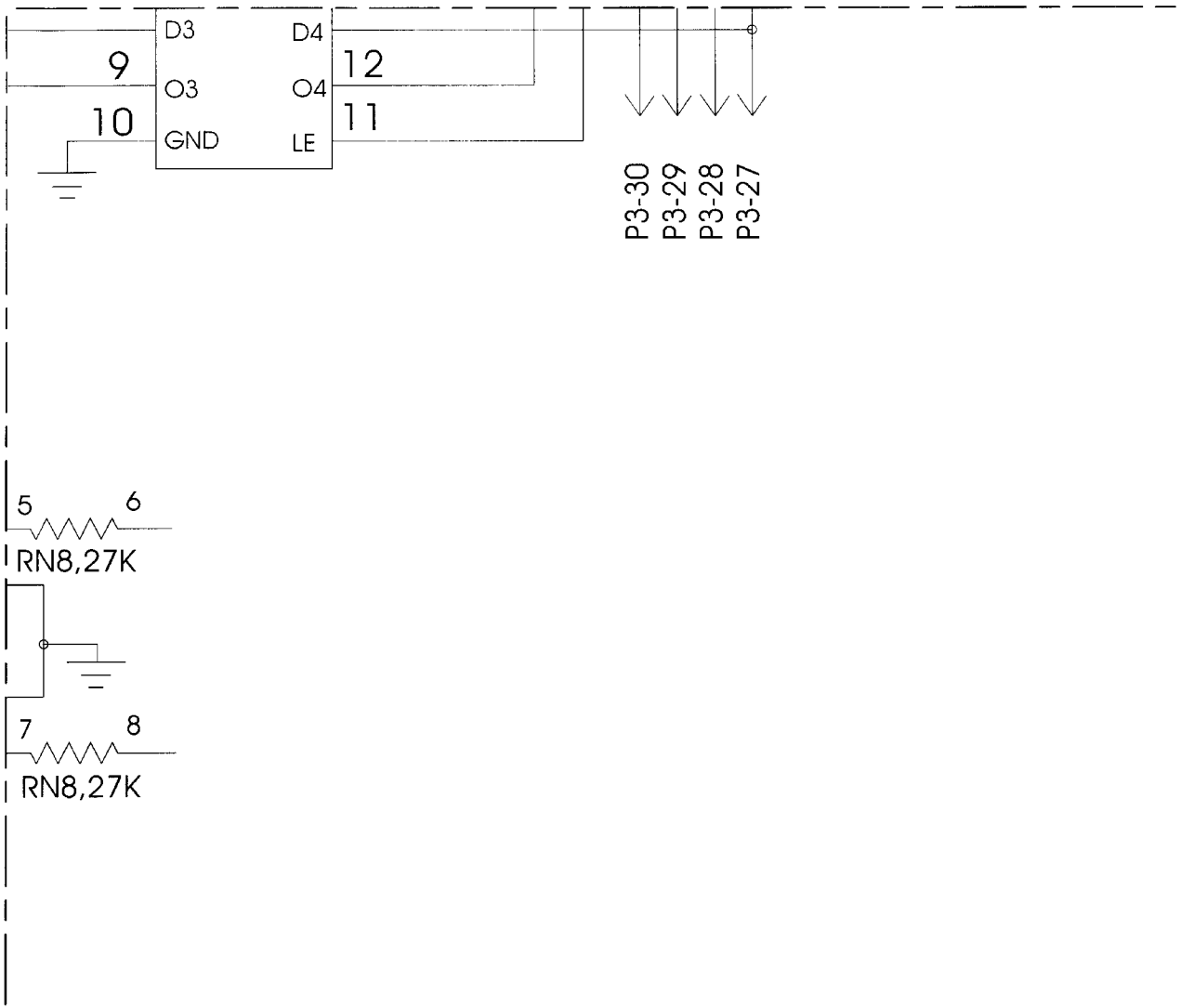
Figure 8A:
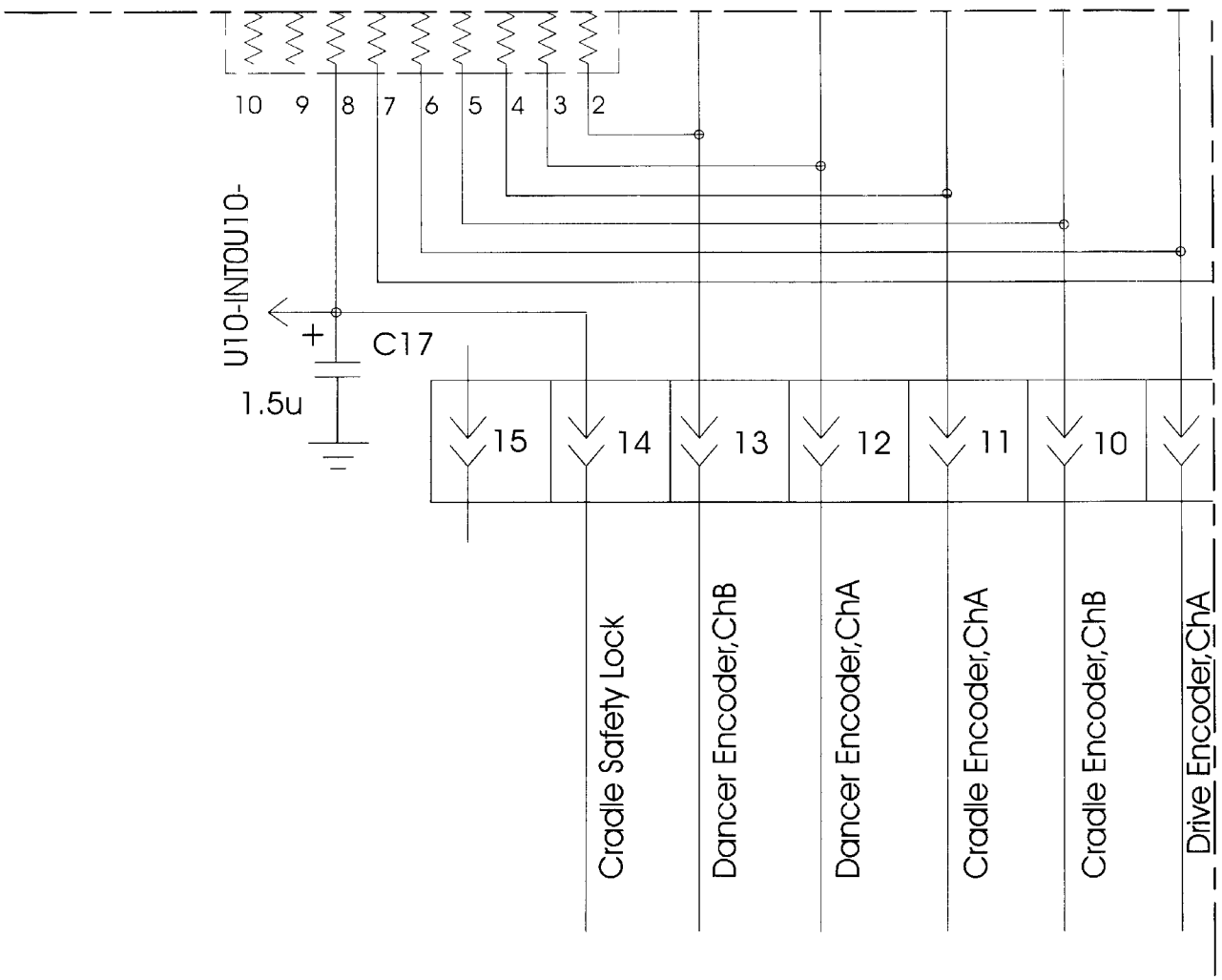
Figure 8A:
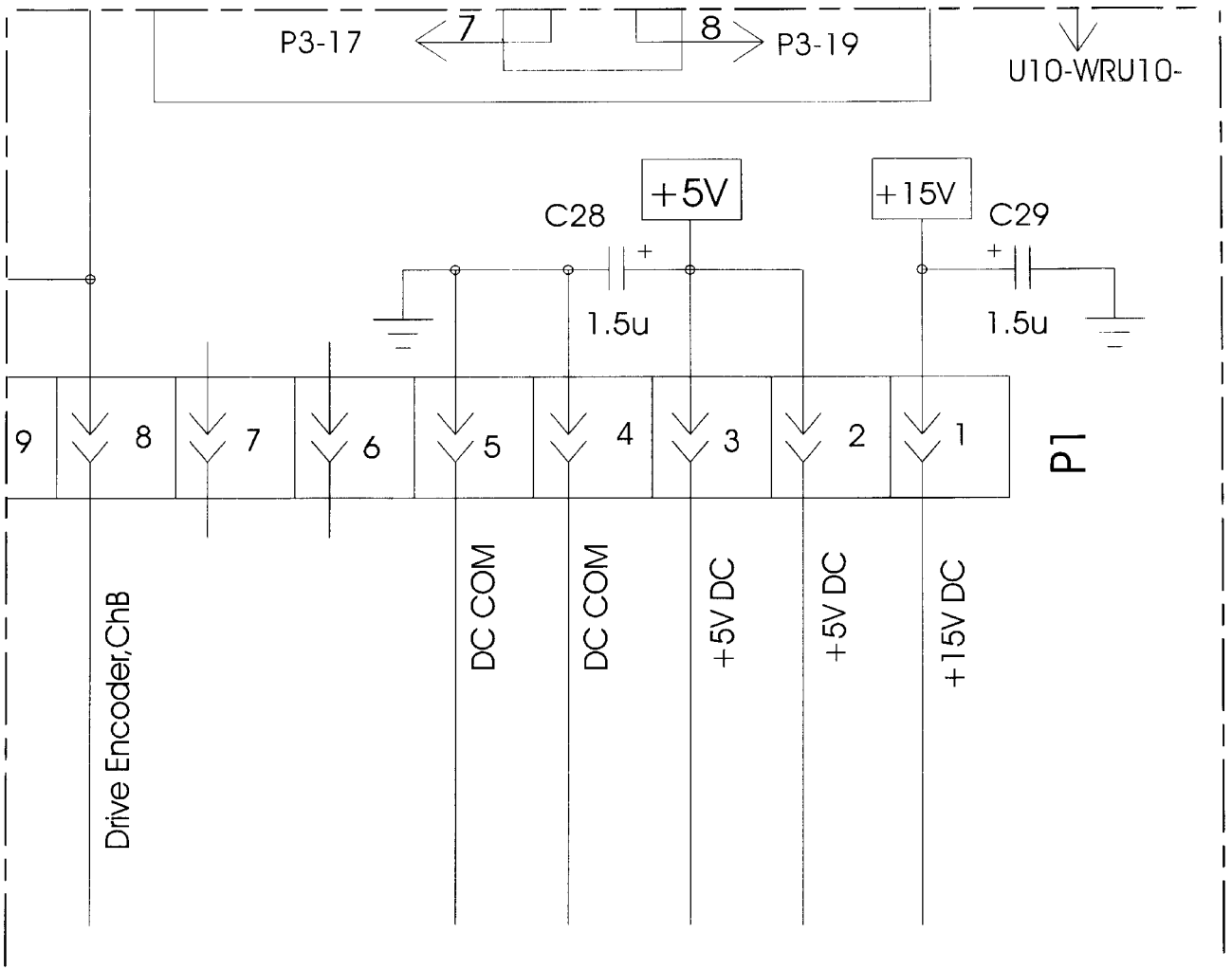
Figure 8A:
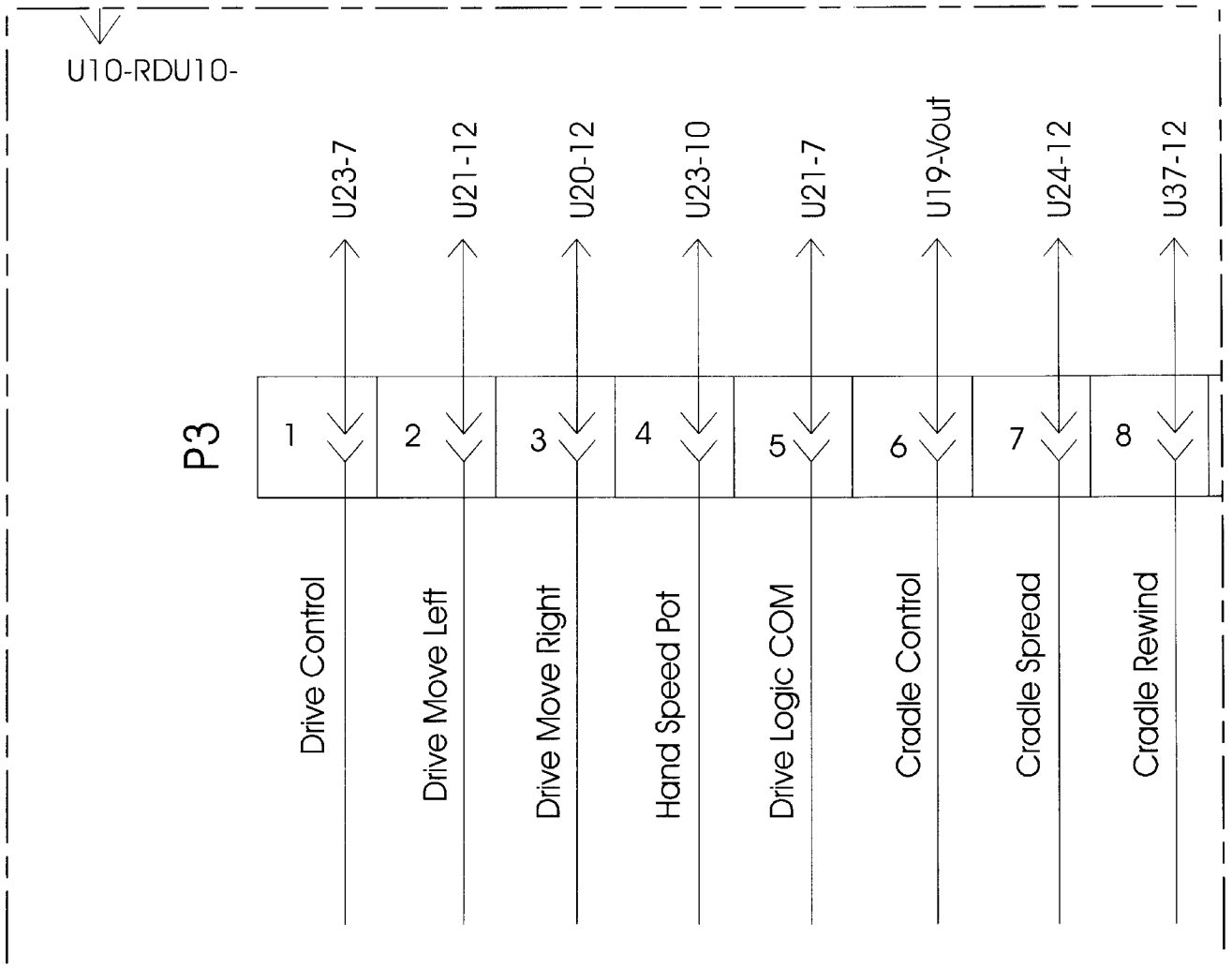
Figure 8A:
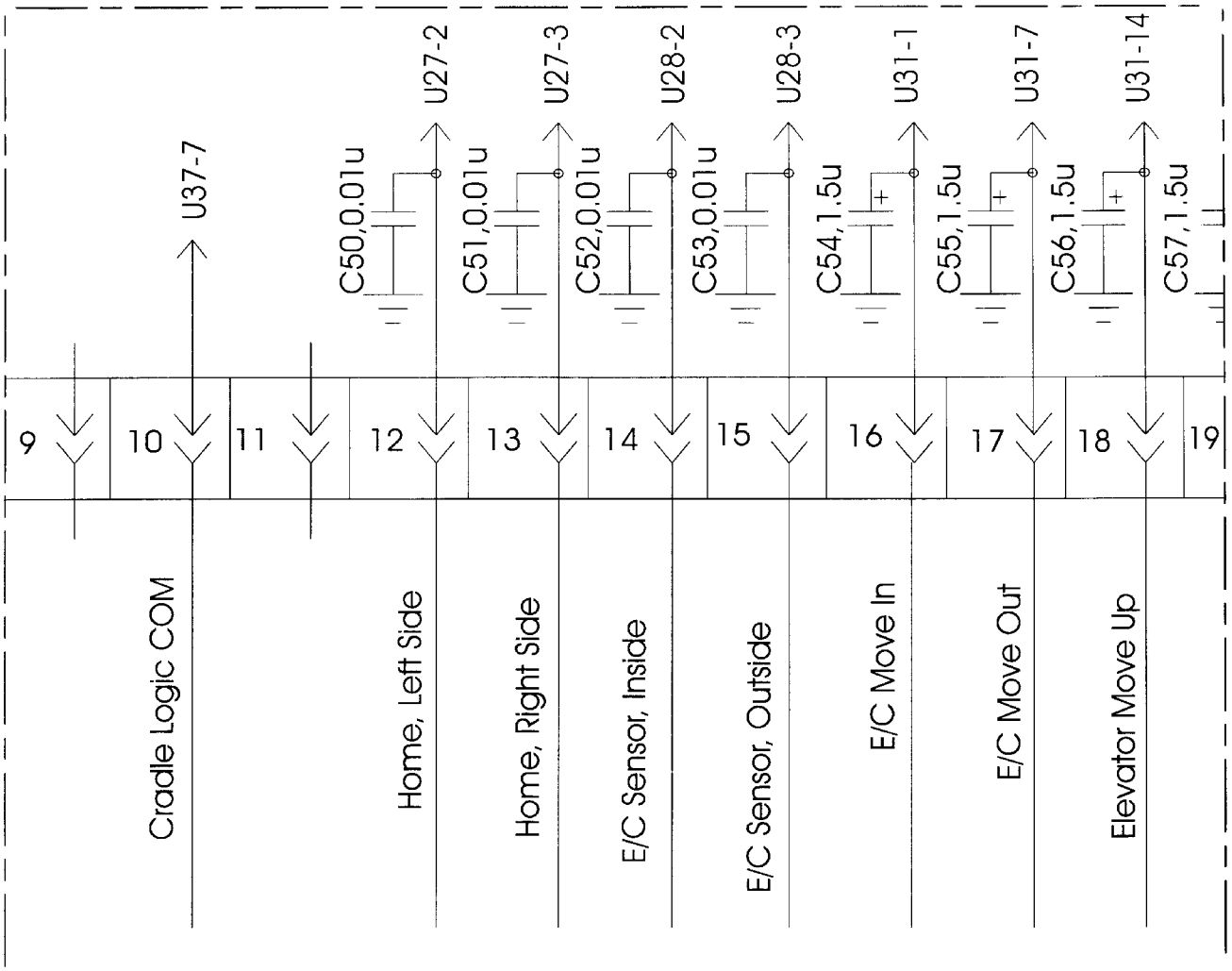
Figure 8A:
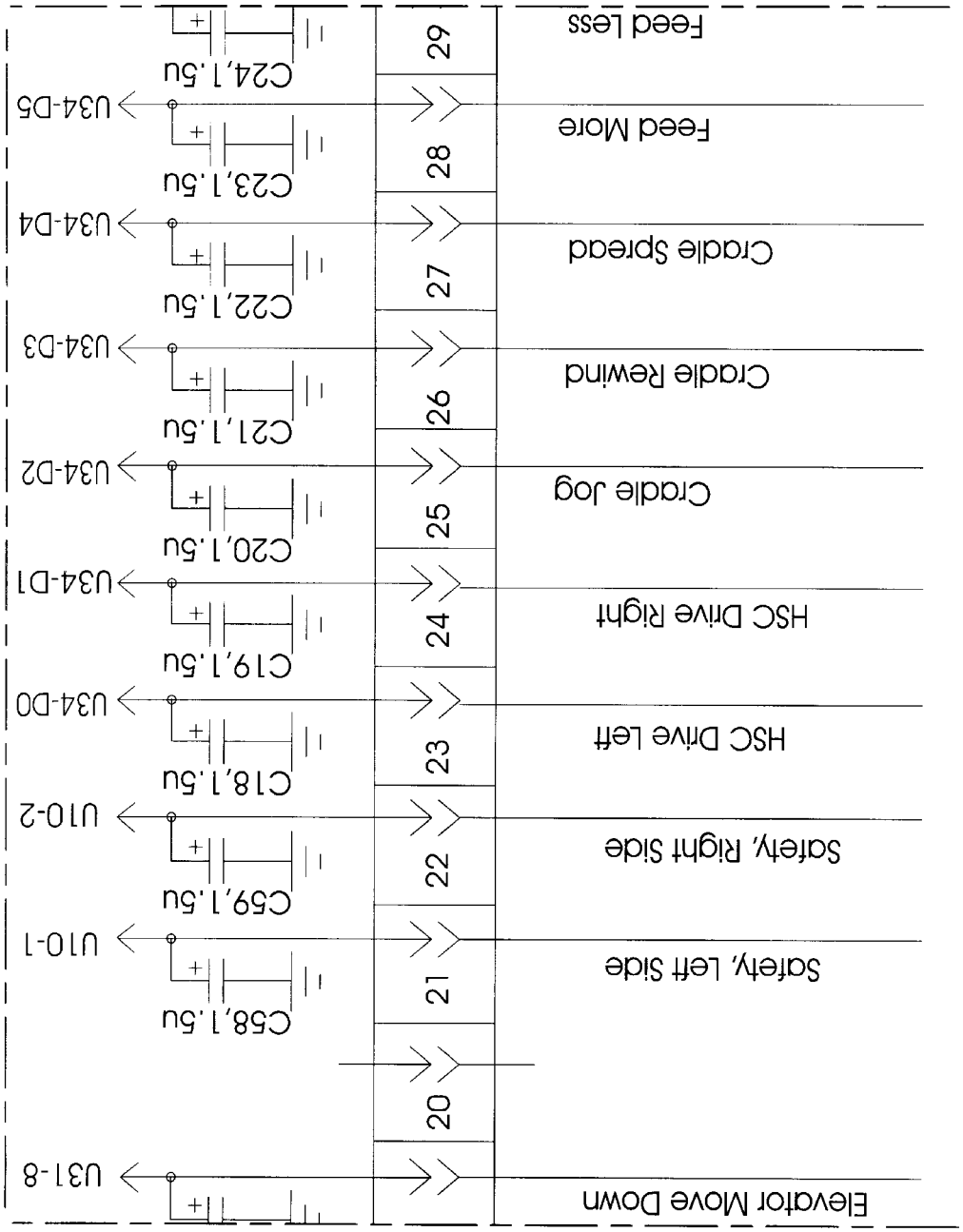
Figure 8A:
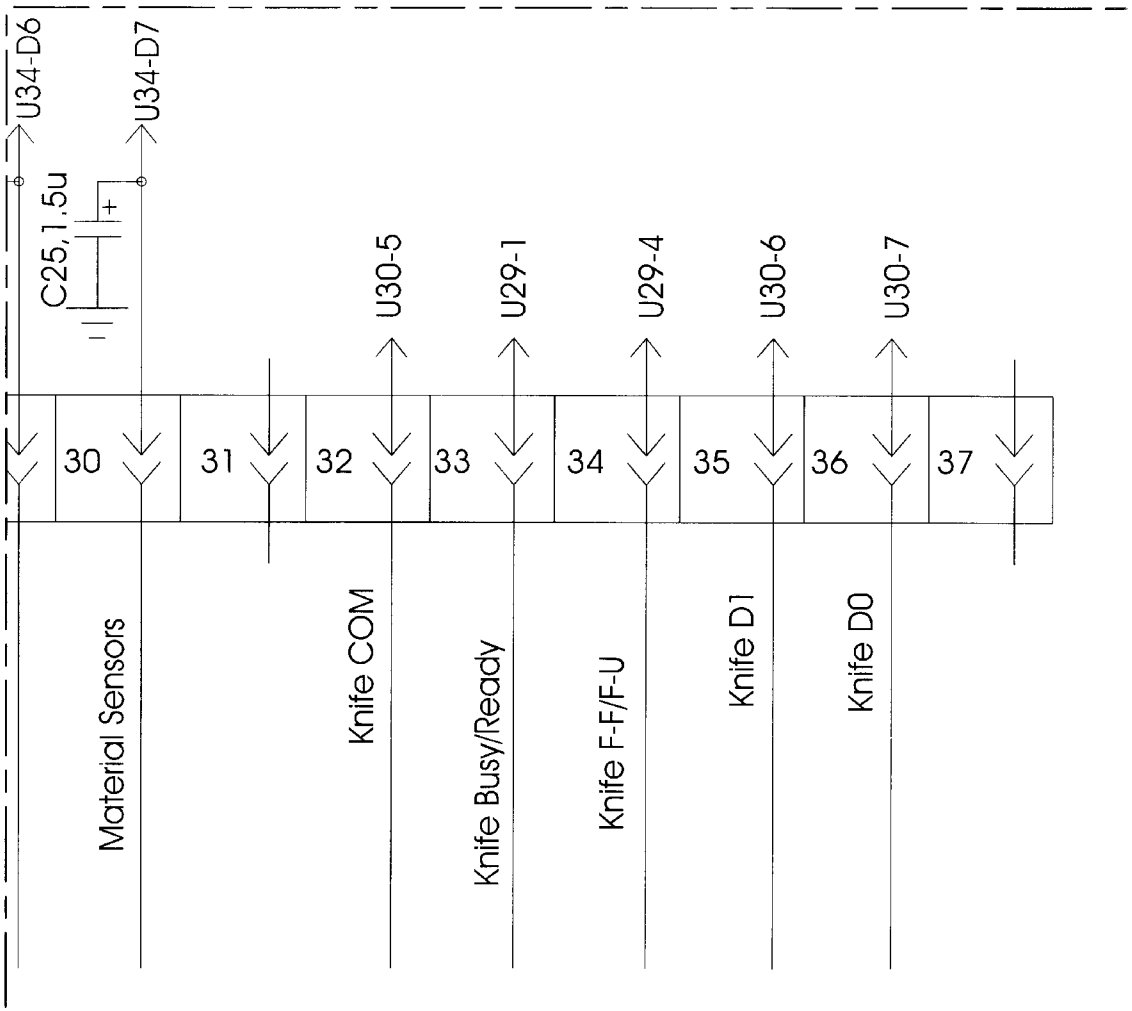

As seen in FIGS. 1, 2, and 7, the control system 70 includes control of the cloth feed motor 38, also in a closed loop feedback control arrangement. This control loop attempts to feed the material onto the spreading table 11 at a rate which corresponds to the velocity of the spreading machine 10 itself. Thus, real time feed rate data is obtained from cradle drive shaft 42 by adjacent feed rate encoder 44. This feed rate data is communicated to microcontroller 78. The required feed rate information is obtained from the machine velocity encoder 29, and the PID algorithm described above is again used to generate a final control signal from microcontroller 78 to feed motor drive 75. Feed motor drive 75, then, converts its control signal to a proportional motor power signal to feed motor 38. This allows the actual material feed rate to conform to the predetermined material feed trajectory plan.

To ensure a tension free spread and to provide increased accuracy of the spread, additional feedback is obtained in the feed control loop from the material trim angular deflection encoder 45. The control system 70 and specifically microcontroller 78 is pre-programmed to provide an optimum angle of deflection of the cloth as it moves along the spread path 13 between second cradle roller 35 and first cloth ramp section 48. A change in cloth tension from optimum will cause a corresponding change in the angle of deflection of dancer bar 46. This change in position is sensed by the angular deflection encoder 45, with the data being provided to microcontroller 78. Microcontroller 78 calculates an appropriate material feed rate adjustment to compensate for the less than optimal angular deflection. This is used to either speed up or slow down the feeding of fabric by adjusting the speed of motor 38 through feed motor drive 75, in accordance with the PID algorithm as described above. As an alternative to using a dancer bar and shaft encoder to monitor material tension, an ultrasonic or other conventional position sensor can be used.

Although the feed rate trajectory will typically be maintained in a one-to-one ratio with the machine speed, the control system 70 can be programmed to deviate to a ratio above or below that.

Control System Electronics

FIG. 8 is a schematic diagram of the electronic sections of the control system 70. The heart of the system 70 is a microcontroller chip U10 (78 on FIG. 2) which can be a conventional device such as an Intel D87C54. The microcontroller chip U10 communicates with the various peripheral and support devices via a conventional system bus (83 on FIG. 2). Timing information is supplied to microcontroller chip E10 by a serial time keeping chip U17, such as a Model DS1302 from Dallas Semiconductor, providing a clock speed of 32.768 kHz. In accordance with a preferred embodiment of control system 70, the data from the encoders 29, 44, 45 is monitored 50 times per second.

Also connected to the system bus 83 and therefore communicating with the microcontroller chip U10 are: LCD Display Module U1 (73 on FIG. 2) which presents status and menu information to the machine operator.

Quadrature decoder chips U2, U4, and U9 which decode data received from the machine velocity encoder 29, feed rate encoder 44 and angular deflection encoder 45, respectively. The quadrature decoder chips U2, U4, and U9 can be types HCTL 2020 from Hewlett-Packard.

Binary up/down counter chips U3 and U5, which count pulses from quadrature decoder chips U2 and U4, respectively. An industry standard type 74F56NN device can be used in this application.

Latch circuits U6 and U7, such as an industry standard 74LS373 device, receive, latch, and transmit to the system bus 83 the signals from momentary contact switches S1 through S21 and S24 through S30, which are part of the keypad unit 72 on FIG. 2.

Opto-isolator circuits U27 and U28 which electrically isolate and buffer signals received from the edge control sensor (80 on FIG. 2).

Opto-isolator circuits U29 and U30 which electrically isolate and buffer signals received from the cutting knife control unit (not shown). Opto-isolator circuits U27 through U30 can be type MCT6/ECG3086 available from Jameco.

Latching circuit U26 which receives and latches output signals from opto-isolator circuits U27 through U30 and delivers them to the system bus 83. Latching circuit U26 can also be an industry standard type 74LS373 octal transparent latch.

Clock oscillator circuit U32 provides timing information to decoder circuits U2, U4, and U9. Clock isolator circuit U32 can be a type CTX163 from Digikey.

Decoder chip U12 can be an industry standard type 74LS137 decoder. Its function is to decode outputs from microcontroller chip U10 as needed by other electronic components of control system 70 as shown in FIG. 8.

D/A converter chip U18 decodes digital drive control signals from microprocessor chip U10 to provide an analog drive control signal to drive motor drive 74, when the control system 70 is under closed loop digital control, as selected through solid state relay U23.

D/A converter chip U19 also decodes digital feed control signals from microprocessor chip U10, and converts them to an analog feed motor drive control signal for use by feed motor drive 75. D/A converter chips U18 and U19 can be type PM7224GP from Analog Devices.

Latch circuit U25 is used to provide proper control signals for the device control relays U20–U24, through U22.

Latching circuit U34 receives and latches signals from hand speed control unit 71 and sends them to the system bus 83. This can also be a type 74LS373 octal transparent latch device.

A quad transistor circuit U31, such as a type ECG2321 from ECG receives digital control signals from microcontroller chip U10 and buffers and transmits them to the drive units (not shown) for the edge control unit 80 and elevator control unit 81.

Solid state relays U20, U21, U23, U24, and U33, in conjunction with transistor circuits U21 and U35, provide a control interface between control system 70 and motor drive 74, and feed motor 75.

Control System Software Description

FIG. 7 is a flow chart that illustrates the general flow of operations implemented by the computer source code used by the control system 70. Further detail about the functioning, structure, and organization of the source code can be found in the Appendix.

When power is activated to spreading machine 10 and control system 70, the microcontroller 78 and related digital electronic components are initialized. Microcontroller 78 then scans the keypad 72 to see if the information and data variables necessary to control the operation of the machine 10 have been inputed by the operator. Alternatively, microcontroller 78 can access a disc file in timing and support section 79 which contains the necessary spreading parameters. The parameters are: machine acceleration rate, spread length, machine top speed, number of plies, spread mode, number of plies to increment elevator control, machine direction (right or left), cradle direction (spread or rewind), elevator control (automatic or manual), dead head speed, move speed, no cloth feature (enable/disable), dancer bar deflection angle, end adjustment (enable/disable), feed rate, splice points, spread staring position, and automatic flaw removal routine. At this point, the control system 70 is in the set up mode and the set up menu is activated and displayed on display unit 73.

Control system 70 then checks to see if all conditions are acceptable to begin a spreading operation. If not, microcontroller 78 begins the housekeeping routine, following which the hand speed control unit 71 is scanned to see if the operator prefers to manually control the spreading machine 10. If the control system 70 senses that the machine 10 is then ready to begin spreading, the trajectory and PID algorithms are calculated, both for machine positioning and cloth feeding, as described above. The machine begins spreading, in accordance with one of five our spreading modes selectable by the operator. Possible modes are:

Mode =0

In this mode, the spreading machine 10 is instructed to implement a face-to-face spread where the cloth is not cut at either end of the spread but is lap folded into catchers at each end of the spreading table 11.

Mode=1

In this mode, the spreading machine 10 implements a face-to-face spread where the cloth is cut by a knife at each end of the spreading table 11 at both ends of the spread.

Mode =2

In this mode, the machine 10 implements a face-up spread from the right to the left side of the spreading table 11, cutting the cloth only at the left. Following the cut, the machine 10 deadheads back to the right to lay the next ply.

Mode =3

In this mode, a face-up spread is implemented from left to right with a knife cut of the cloth at the right end of the spread, with the machine 10 deadheading back to the left to lay the next ply.

At the beginning of each spread regardless of mode, control system 70 must be provided with a home position which is used by the control system 70 to determine an absolute machine displacement or position based on the data provided by the machine velocity encoder 48. Accordingly, when machine 10 begins spreading, it travels along spreading table 11 to the physical "home point" which can be a nub or other physical marker permanently attached to the spreading table 11 at a known location anywhere along the spread. A sensor attached to machine mainframe 15, such as a microswitch, makes physical contact with the marker on the table 11, telling the control system 70 that the home point has been reached. Control system 70 then stops the machine 10, and reverses it causing it to again pass over the home point. The machine is then ready to start spreading cloth.

On every other pass of the machine over the home point, a pulse is generated by home pulse generator 84 as described, telling the control system 70 that the home point has been reached. Control system 70 then checks its own position data obtained and calculated from machine velocity encoder 48 as to its position. If there is a deviation between calculated and known home position, an adjustment is made in accordance with the machine trajectory algorithm.

During the spread, the velocity of the spreading machine 10 is controlled in real time in accordance with the velocity trajectory plan, an example of which is illustrated in FIG. 9. The cloth feed rate is also dynamically controlled, based on real time measurement of machine velocity and on feedback obtained from the angular deflection encoder 45. The machine 10 continues to spread cloth in accordance with the trajectory plan until the ply counter determines that all plies have been laid. The control system 70 then returns to the waiting mode where it will scan the keypad unit 72 or access a disc file for the next spread.

As described in more detail in the source code listing in the Appendix, before the spread begins, the control system 70 checks to see if there is cloth loaded in the machine, checks to see if the dancer bar 46 is in position and operable, and confirms that the home point has been found. During the spread, and in addition to dynamically adjusting machine speed and feed rate in accordance with the trajectory plans, the control system reacts to and controls the cutting knives (if present), the edge control sensor and unit 80, and the elevator control unit 81.

Thus, although there have been described particular embodiments of the present invention of a new and useful improved control system for a cloth spreading machine, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What is claimed is:

1. A control system for a material spreading machine that includes a drive mechanism for driving the machine along the top of a spreading table and a feed mechanism for feeding material from a roll mounted on the machine while the machine moves along the table, the control system comprising:

a. spread parameter data input means to receive spread parameter data selected by a user of the machine, the spread parameter data including length of the spread and a number of plies of the material to be laid on the table during a planned spread;

b. machine trajectory processor means for storing a machine velocity trajectory plan, the machine velocity trajectory plan including a sequence of electrical signals representing pre-determined machine velocities at multiple periodic timing intervals during the planned spread;

c. machine velocity sensor means for monitoring actual machine velocity at each of the periodic timing intervals while the machine is moving along the table during the planned spread, and for generating electrical machine velocity signals corresponding to the actual machine velocity;

d. machine velocity control means for controlling the machine velocity during the planned spread in accordance with the machine trajectory plan, the machine velocity control means operatively connected to the drive mechanism and to the machine trajectory processor means, and responsive to the machine velocity signals whereby the machine velocity control means can adjust the actual machine velocity to correct a monitored deviation from the pre-determined machine velocity.

2. The control system of claim 1 wherein the spread parameter data further includes a machine acceleration rate and a maximum machine velocity, and wherein the machine trajectory processor means includes means for calculating the machine velocity trajectory plan based on the spread parameter data.

3. The control system of claim 2 further comprising machine position processor means for calculating actual positions of the machine along the table at multiple timing intervals during the planned spread, the machine position processor means operatively connected to the machine velocity sensor means such that calculation of the actual machine position is based on integration of the actual machine velocity over time.

4. The control system of claim 3 further comprising a home position signaling means to generate an electrical signal to the control system to indicate when the machine has moved to a pre-determined and fixed home position on the table.

5. The control system of claim 4 wherein the machine position processor means is operatively connected to and responsive to the home position signalling means, and includes means to correct errors in the calculated actual machine positions based on the home position signals.

6. The control system of claim 5 wherein the drive mechanism includes a drive motor and at least one rotating drive shaft and the machine velocity sensor means comprises a machine velocity shaft encoder mounted proximate the drive shaft.

7. The control system of either of claims 1 through 6, further comprising feed rate control means for controlling an actual feed rate at which the material feeds off the roll during the planned spread, the feed rate control means operatively connected to the feed mechanism.

8. The control system of claim 7 further comprising:

a. feed trajectory processor means for storing a feed rate trajectory plan, the feed rate trajectory plan including a sequence of electrical feed rate signals representing pre-determined feed rates at multiple periodic timing intervals during the planned spread; and b. the feed rate control means operatively connected to the feed trajectory processor means and responsive to the feed rate signals whereby the feed rate control means can adjust the actual feed rate to conform to the feed rate trajectory plan.

9. The control system of claim 8 further comprising:

a. feed rate sensor means for monitoring actual material feed rates at each of the periodic timing intervals while the machine is moving along the table during the planned spread, and for generating electrical feed rate signals corresponding to the actual feed rate;

b. the feed rate control means responsive to the feed rate signals whereby the feed rate control means can adjust the actual feed rate to correct a monitored deviation from the pre-determined feed rate.

10. The control system of claim 9 wherein the feed trajectory processor means includes means for calculating the feed trajectory plan based on the machine velocity plan such that the material feeds off the roll at rates which are proportional to the machine velocities during the planned spread.

11. The control system of claim 10 wherein the feed mechanism includes a feed motor and at least one rotating feed mechanism shaft, and the feed rate sensor means comprises a feed rate shaft encoder mounted proximate the feed mechanism shaft.

12. The control system of claim 11 further comprising material tension control means for monitoring and adjusting the tension of the material as it feeds off the roll during the planned spread.

13. The control system of claim 12 wherein the material tension control system comprises:

a. angular deflection sensing means for measuring an angular position of the material at a fixed point on the machine after the material leaves the roll during the planned spread; and b. tension feedback control means to adjust the actual feed rate during the planned spread when the angular deflection sensing means measures a change in angular position of the material from a pre-set angular position.

14. A machine for feeding material off of a roll and onto a spreading table during a spread operation, the machine comprising:

a. means to support the roll on the machine;

b. drive means to move the machine horizontally along the table in forward and reverse directions during the spread operation;

c. feed means to rotate the roll and feed the material off of the machine as the machine moves along the table;

d. drive control means, connected to the drive means, to control the movement of the machine in accordance with pre-determined machine movement data, the movement data including pre-determined machine velocities at multiple points in time throughout the spread operation;

f. the drive means includes a drive motor;

g. the drive control means includes a drive motor drive which is connected to and controls the speed of the drive motor;

h. the drive control means includes a machine velocity sensor which measures the actual velocity of the machine during the spread operation; and i. the drive control means is responsive to the machine velocity sensor such that the speed of the drive motor is adjusted to correct the actual machine velocities during the spread operation to conform to the pre-determined machine velocities.

15. The machine of claim 14 wherein the drive means includes a main drive belt which is driven by the drive motor and the machine further comprises tension control means to automatically adjust main drive belt tension during the spreading operation.

16. The machine of claim 15 further comprising processor means to calculate one or more actual positions of the machine along the table during the spread operation based on integration of the actual machine velocities.

17. The machine of claim 16 further comprising home position sensor means mounted to the machine to determine when the machine passes over a known position on the table during the spread operation.

18. The machine of claim 14 further comprising feed control means, connected to the feed means, to control an actual feed rate at which the material feeds off the roll such that the actual feed rate varies in response to variations in the actual machine velocity.

19. The machine of claim 18 wherein the feed control means includes means to control the feed rate in accordance with pre-determined feed rate data, the feed rate data including pre-determined feed rates at multiple points in time throughout the spread operation.

20. The machine of claim 19 wherein:

a. the feed means includes a feed motor;

b. the feed control means includes a feed motor drive which is connected to and controls the speed of the feed motor;

c. the feed control means includes a feed rate sensor which measures the actual feed rate of the machine during the spread operation; and d. the feed control means is responsive to the feed rate sensor such that the speed of the feed motor is adjusted to correct the feed rates during the spread operation to conform to the pre-determined feed rates.

21. A method of feeding material off of a roll and on to a spreading table, the roll being supported on a spreading machine whereby a feed mechanism on the spreading machine rotates the roll in accordance with signals from a machine control system, and the spreading machine having a drive mechanism which moves the spreading machine horizontally along the table at a machine velocity which is variable in accordance with drive control signals from the machine control system, the method comprising the steps of:

a. storing in the machine control system a machine velocity trajectory plan which includes pre-determined machine velocities as a function of time during a planned spread;

b. using the pre-determined machine velocities to generate drive control signals for the drive mechanism such that actual velocities of the machine at multiple time intervals during the planned spread are substantially equal to time-corresponding pre-determined machine velocities; and c. rotating the roll during the planned spread such that the material feeds off of the machine at a feed rate which varies in accordance with variations in the actual machine velocities.

22. The method of claim 21 further comprising the step of determining the machine velocity trajectory plan in the control system using spread parameters electronically communicated to the control system by a user of the machine, the spread parameters including spread length, machine acceleration rate, and maximum machine velocity.

23. The method of either claim 21 or 22 further comprising the steps of:

a. measuring the actual machine velocities at multiple time intervals during the planned spread by using a machine velocity sensor mounted on the machine; and b. using the actual machine velocities measured by the machine velocity sensor to adjust the drive control signals such that deviations in actual machine velocities from the pre-determined machine velocities, as measured at one or more time intervals during the planned spread, are corrected in real time.

24. The method of claim 23 further comprising the steps of:

a. storing in the machine control system a feed rate trajectory plan which includes pre-determined feed rates as a function of time during the planned spread;

b. using the pre-determined feed rates to generate feed control signals for the feed mechanism such that actual feed rates of the machine at multiple time intervals during the planned spread are substantially equal to time-corresponding pre-determined feed rates.

25. The method of claim 24 further comprising the steps of:

a. measuring the actual feed rates at multiple time intervals during the planned spread by using a feed rate sensor mounted on the machine; and b. using the actual feed rates measured by the feed rate sensor to adjust the feed control signals such that deviations in actual feed rates from the pre-determined feed rates, as measured at one or more time intervals during the planned spread, are corrected in real time.

26. The method of claim 25 wherein the actual machine velocity is measured at least 50 times/second during the spread.

27. The method of claim 25 further comprising the step of calculating in the machine control system a position of the machine along the table in real time during the planned spread by integrating the measured actual machine velocities over time.

28. The method of claim 27 further comprising the step of correcting errors in the actual machine positions calculated by the control system by repeatedly sensing a fixed home position along the table as the machine moves over the home position.

* * * * *